US008739929B2

(12) United States Patent
Meillet et al.

(10) Patent No.: US 8,739,929 B2
(45) Date of Patent: Jun. 3, 2014

(54) RETRACTABLE HORIZONTAL LIFELINE ASSEMBLY

(75) Inventors: Vincent G. Meillet, Cannes la Bocca (FR); J. Thomas Wolner, Red Wing, MN (US); Scott C. Casebolt, St. Paul Park, MN (US); Damien de Lapeyriere, Dardilly (FR); Charles C. Bryant, Red Wing, MN (US)

(73) Assignee: D B Industries, LLC, Red Wing, MN (US)

( * ) Notice: Subject to any disclaimer, the term of this patent is extended or adjusted under 35 U.S.C. 154(b) by 0 days.

(21) Appl. No.: 13/541,362

(22) Filed: Jul. 3, 2012

(65) Prior Publication Data

US 2012/0298446 A1 Nov. 29, 2012

Related U.S. Application Data

(63) Continuation of application No. 11/619,004, filed on Jan. 2, 2007, now abandoned, which is a continuation-in-part of application No. 11/463,085, filed on Aug. 8, 2006, now abandoned.

(51) Int. Cl.
*A62B 35/00* (2006.01)

(52) U.S. Cl.
USPC ..... 182/3; 254/368

(58) Field of Classification Search
USPC ..... 182/3; 242/368
See application file for complete search history.

(56) References Cited

U.S. PATENT DOCUMENTS 2,791,397 A 11/1954 Coffman
3,843,094 A 10/1974 Watts
4,566,674 A * 1/1986 Ebey et al. ..... 254/345
5,156,240 A 10/1992 Ostrobrod
5,447,280 A 9/1995 Feathers
5,458,214 A 10/1995 Olson et al.
5,957,432 A 9/1999 Ostrobrod
6,149,132 A 11/2000 Ostrobrod
6,431,525 B1 * 8/2002 Roll ..... 254/357

(Continued)

FOREIGN PATENT DOCUMENTS

EP 1 447 114 A1 8/2004
EP 1 707 525 A1 10/2006

(Continued)

OTHER PUBLICATIONS

"Gemtor™ Owner's Manual", Gemtor, Inc., pp. 1-16 (© 1998-2000 Gemtor, Inc.).

(Continued)

*Primary Examiner* — Alvin Chin Shue
(74) *Attorney, Agent, or Firm* — IPLM Group, P.A.

(57) ABSTRACT

A retractable horizontal lifeline assembly includes a lifeline windable about and paid out from a rotatable drum and a housing. The housing includes a first connector and is configured and arranged to house the drum and the lifeline wound about a base of the drum. The first connector is operatively connected to a first anchorage structure, the lifeline is pulled outward from proximate the housing thereby paying out at least a portion of the lifeline from the drum, a second connector operatively connected to the lifeline is operatively connected to a second anchorage structure, and the lifeline is tensioned using a crank that rotates the drum to increase the tension in the lifeline and provides indication when the tension in the lifeline reaches a predetermined level.

35 Claims, 28 Drawing Sheets

(56) References Cited

U.S. PATENT DOCUMENTS

| | | | | |
|---|---|---|---|---|
| 6,446,936 | B1 * | 9/2002 | Ostrobrod | 254/368 |
| 6,655,242 | B2 | 12/2003 | Gambarini | |
| 6,742,418 | B2 | 6/2004 | Amami | |
| 6,814,152 | B2 | 11/2004 | Ginell | |
| 6,854,415 | B2 | 2/2005 | Barnes et al. | |
| 6,978,705 | B1 | 12/2005 | Lee | |
| 6,990,877 | B1 * | 1/2006 | Wu | 81/467 |
| 7,111,532 | B2 | 9/2006 | Wu | |
| 2005/0051659 | A1 | 3/2005 | Wolner et al. | |
| 2007/0200023 | A1 * | 8/2007 | Konishi | 242/402 |
| 2008/0041661 | A1 | 2/2008 | Meillet et al. | |
| 2008/0128221 | A1 | 6/2008 | Rogge | |
| 2009/0224219 | A1 | 9/2009 | Woodruff | |
| 2012/0298445 | A1 | 11/2012 | Meillet et al. | |

FOREIGN PATENT DOCUMENTS

| | | | |
|---|---|---|---|
| FR | 1 357 673 | | 4/1964 |
| GB | 2 437 074 | A | 10/2007 |
| WO | WO 2007/116202 | A1 | 10/2007 |

OTHER PUBLICATIONS

Illustration of reserve lifeline (cable) portion for a self-retracting lifeline known of prior to Jan. 2, 2007, 1 page.

Illustration of reserve lifeline (web) portion for a self-retracting lifeline known of prior to Jan. 2, 2007, 1 page.

International Search Report from PCT/US2007/075318 mailed Feb. 4, 2008.

"MSE Cable Unitensioner®", Mechanical Safety Equipment Corp., 2 pgs. (Date unknown).

"MSE Temporary Horizontal Cable Lifeline System with Cable Unitensioner®", Mechanical Safety Equipment Corp., 2 pgs. (Date unknown).

"Tirsafe™—Temporary Horizontal Lifeline System", "fallstop®—safety equipment for work at heights", Tractel Ltd.—Fallstop Division, p. 30 (© 2005 Tractel).

Office Action issued in parent U.S. Appl. No. 11/619,004, entitled "Retractable Horizontal Lifeline Assembly", 10 pages, mailed Jan. 28, 2010.

Office Action issued in parent U.S. Appl. No. 11/619,004, entitled "Retractable Horizontal Lifeline Assembly", 6 pages, mailed May 24, 2010.

Office Action issued in parent U.S. Appl. No. 11/619,004, entitled "Retractable Horizontal Lifeline Assembly", 13 pages, mailed Aug. 23, 2010.

Office Action issued in parent U.S. Appl. No. 11/619,004, entitled "Retractable Horizontal Lifeline Assembly", 8 pages, mailed May 5, 2011.

Office Action issued in parent U.S. Appl. No. 11/619,004, entitled "Retractable Horizontal Lifeline Assembly", 9 pages, mailed Jul. 25, 2011.

* cited by examiner

FIG. 10
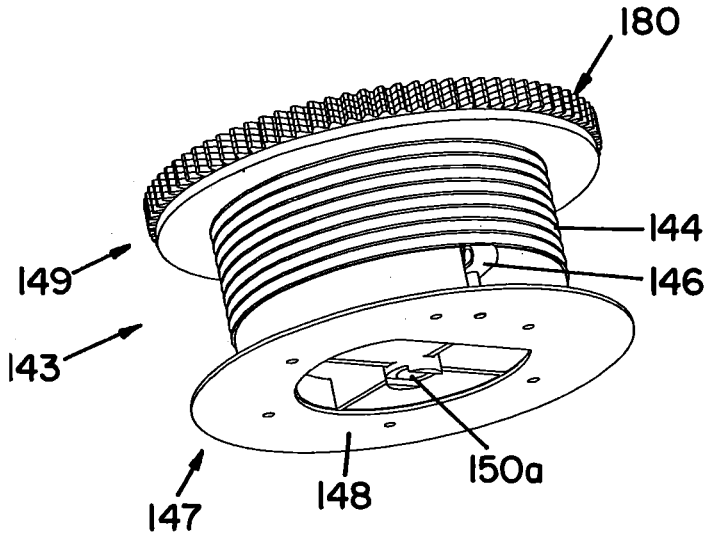
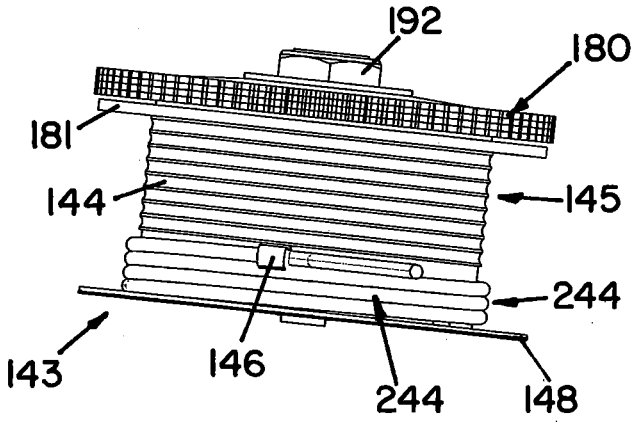
FIG. 11

FIG. 12
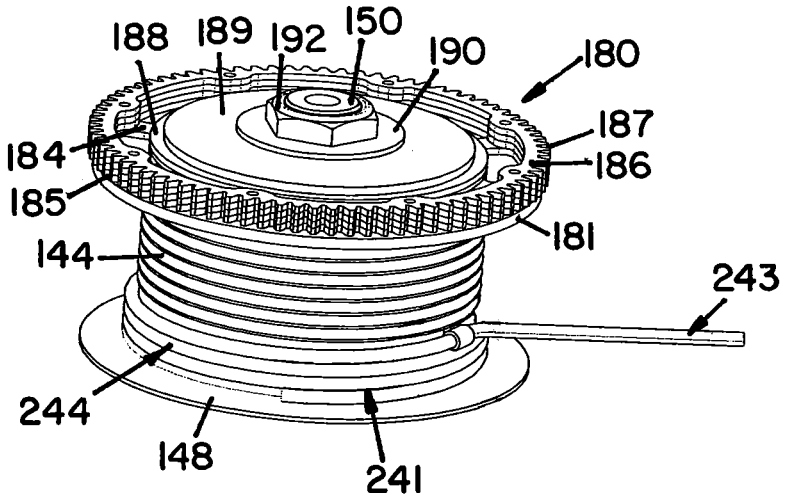
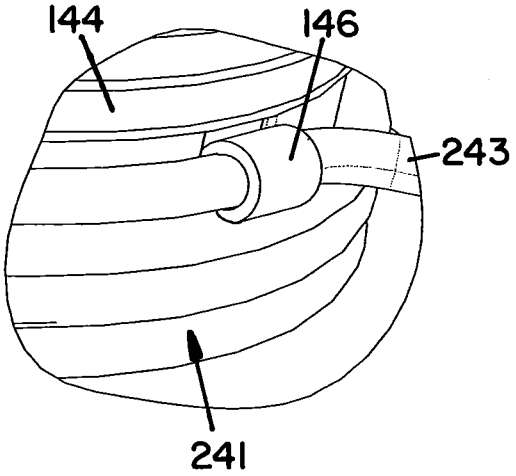
FIG. 13

FIG. 14
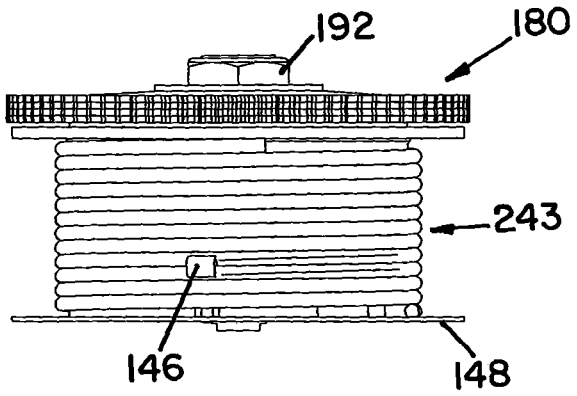
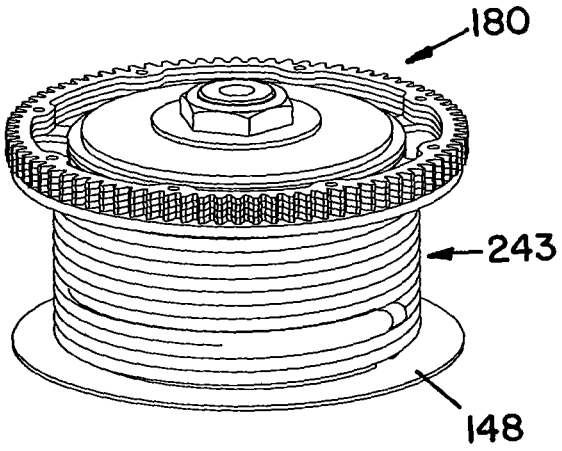
FIG. 15

FIG. 16
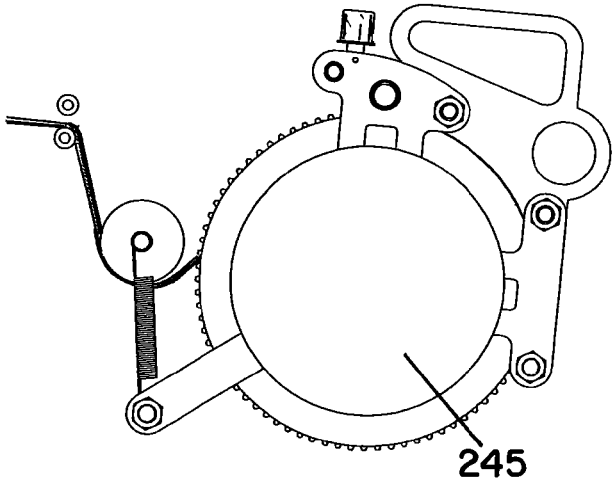
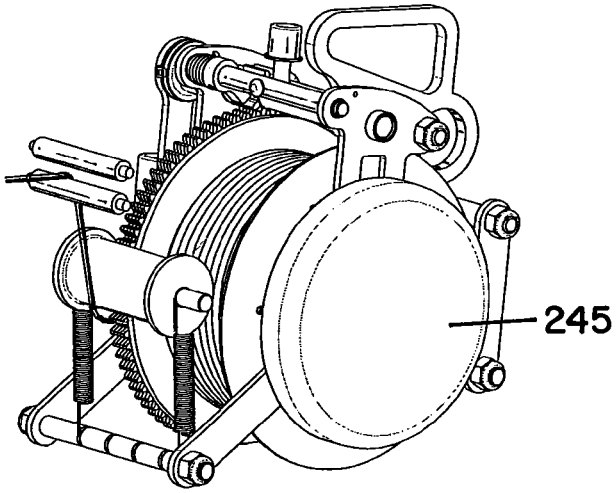
FIG. 17

FIG. 21
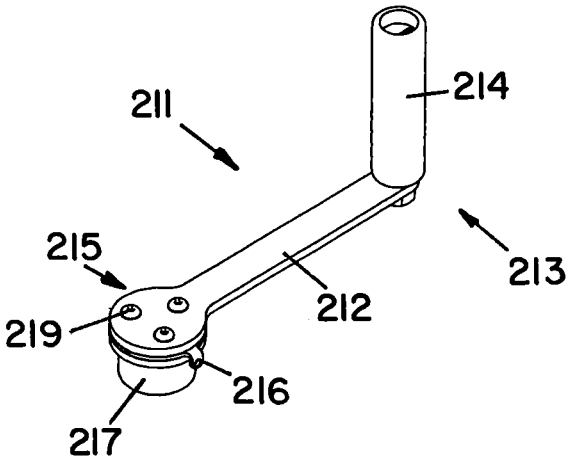
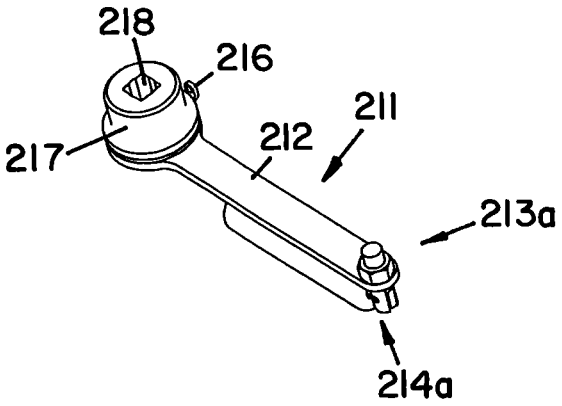
FIG. 22

FIG. 30
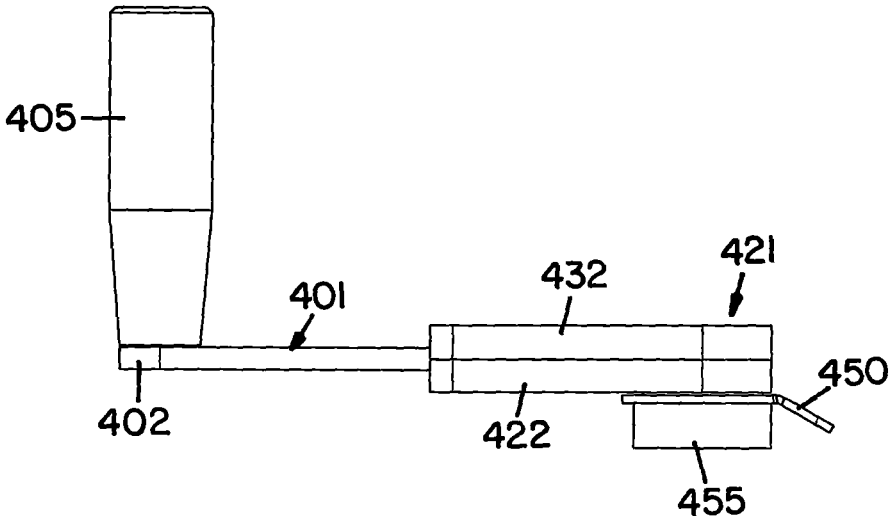
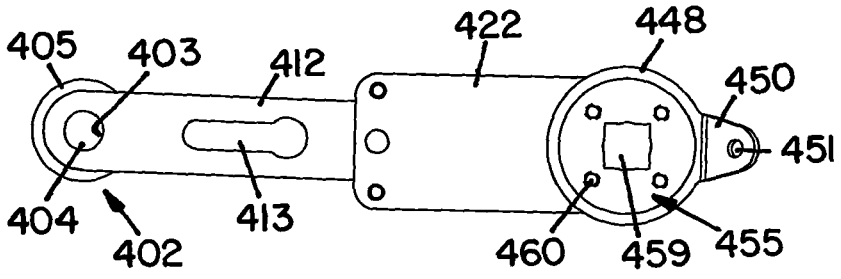
FIG. 31

FIG. 32
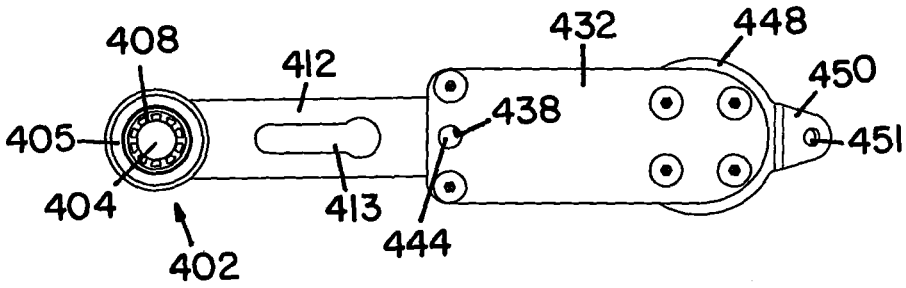
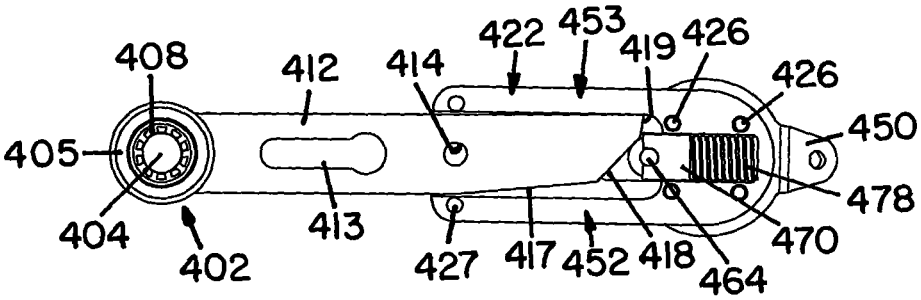
FIG. 33

FIG. 34
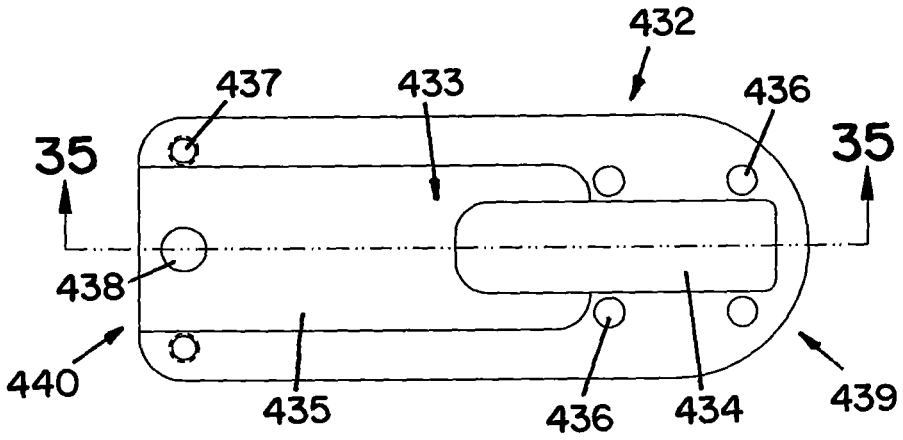
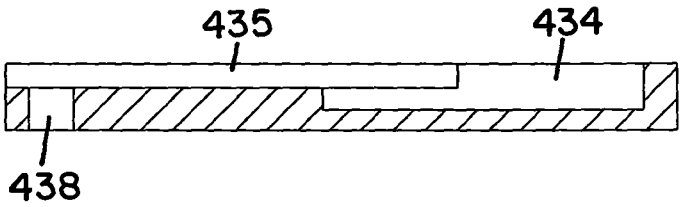
FIG. 35

RETRACTABLE HORIZONTAL LIFELINE ASSEMBLY

This application is a continuation application of U.S. application Ser. No. 11/619,004, filed Jan. 2, 2007, which is a continuation-in-part application of U.S. application Ser. No. 11/463,085, filed Aug. 8, 2006, which are incorporated by reference herein.

FIELD OF THE INVENTION

The present invention relates to a retractable horizontal lifeline assembly.

BACKGROUND OF THE INVENTION

Various occupations place people in precarious positions at relatively dangerous heights thereby creating a need for fall protection and fall arrest apparatus. As a result, many types of safety apparatus have been developed to reduce the likelihood of a fall and/or injuries associated with a fall. Among other things, such apparatus typically include an interconnection between at least one anchorage point and a safety harness worn by a user performing tasks in proximity to the at least one anchorage point. One type of interconnection commonly used is a horizontal lifeline interconnected between at least two anchorage points, along the length of which the user may move and perform tasks. The user's safety harness is typically connected to the horizontal lifeline with a lanyard or other suitable device.

SUMMARY OF THE INVENTION

One aspect of the present invention provides for a retractable horizontal lifeline assembly operatively connected to a first anchorage structure and to a second anchorage structure comprising a lifeline, a drum, a housing, a brake assembly, a pinion gear, a pawl, and a crank. The lifeline has a first end, a second end, and an intermediate portion interconnecting the first end and the second end. The drum has a base and is rotatable. The first end of the lifeline is operatively connected to the drum and the intermediate portion of the lifeline is windable about and paid out from the base. The housing is configured and arranged to house the drum and a portion of the lifeline wound about the base and includes an exit through which another portion of the lifeline extends. The brake assembly is operatively connected to the drum and includes a main plate having first teeth. The pinion gear has second teeth in cooperation with the first teeth whereby when the main plate rotates the first teeth engage the second teeth to cause the pinion gear to rotate. The pawl is pivotally mounted with respect to the housing proximate the pinion gear and has an engaging position and a releasing position. The engaging position engages the second teeth preventing the pinion gear from rotating in a first direction, and the releasing position releases the second teeth allowing the pinion gear to rotate in the first direction. When the pinion gear is engaged by the pawl, the main plate is also prevented from rotating in a second direction. The crank is selectively releasably operatively connectable to one of the drum and the pinion gear to rotate the drum.

One aspect of the present invention provides for a retractable horizontal lifeline assembly operatively connected to a first anchorage structure and to a second anchorage structure comprising a lifeline, a drum, a tension assembly, and a housing. The lifeline has a first end, a second end, and an intermediate portion interconnecting the first end and the second end. The second end includes a second connector. The drum has a base and is rotatable. The first end of the lifeline is operatively connected to the drum and the intermediate portion of the lifeline is windable about and paid out from the base. The housing includes a first connector and is configured and arranged to house the drum, the lifeline wound about the base of the drum, and the tension assembly. The drum is rotatably mounted within the housing, and the tension assembly is mounted within the housing. The first connector is operatively connected to the first anchorage structure, the second end of the lifeline is pulled outward from proximate the housing thereby paying out at least a portion of the intermediate portion from the drum, the second connector is operatively connected to the second anchorage structure, and the tension assembly is used to fixedly tension the lifeline.

One aspect of the present invention provides for a retractable horizontal lifeline assembly operatively connected to a first anchorage structure and to a second anchorage structure comprising a lifeline, a drum, a brake assembly, a pinion gear, and a pawl. The lifeline has a first end, a second end, and an intermediate portion interconnecting the first end and the second end. The drum has a base and is rotatable. The first end of the lifeline is operatively connected to the drum and the intermediate portion of the lifeline is windable about and paid out from the base. The brake assembly is operatively connected to the drum and includes a main plate with first teeth. The pinion gear has second teeth in cooperation with the first teeth whereby when the main plate rotates the first teeth engage the second teeth to cause the pinion gear to rotate. The pawl is pivotally mounted with respect to the housing proximate the pinion gear and has an engaging position and a releasing position. The engaging position engages the second teeth to prevent the pinion gear from rotating in a first direction. The releasing position releases the second teeth to allow the pinion gear to rotate in the first direction. When the pinion gear is engaged by the pawl, the main plate is also prevented from rotating in a second direction.

One aspect of the present invention provides for a retractable horizontal lifeline assembly operatively connected to a first anchorage structure and to a second anchorage structure comprising a lifeline, a drum, and a crank. The lifeline has a first end, a second end, and an intermediate portion interconnecting the first end and the second end. The second end is operatively connected to the second anchorage structure. The drum has a base and is rotatable. The first end of the lifeline is operatively connected to the drum and the intermediate portion of the lifeline is windable about and paid out from the base. The drum is operatively connected to the first anchorage structure. The crank is configured and arranged to be releasably connectable to the drum and is rotatable to rotate the drum and tension the lifeline. The crank includes a tension indicator to provide indication when the tension in the lifeline has reached a predetermined level. The crank is capable of tensioning the lifeline to a level greater than the predetermined level.

One aspect of the present invention provides for a retractable horizontal lifeline assembly operatively connected to a first anchorage structure and to a second anchorage structure comprising a lifeline, a drum, and a crank. The lifeline has a first end, a second end, and an intermediate portion interconnecting the first end and the second end. The second end is operatively connected to the second anchorage structure. The drum has a base and is rotatable. The first end of the lifeline is operatively connected to the drum and the intermediate portion of the lifeline is windable about and paid out from the base. The drum is operatively connected to the first anchorage structure. The crank is configured and arranged to be releasably connectable to the drum. A torque is applied to the crank corresponding to a predetermined level of tension in the lifeline. The crank is rotated to rotate the drum and tension the lifeline and when the torque applied to the crank is reached, the lifeline has reached the predetermined level of tension. The crank is capable of tensioning the lifeline to a level greater than the predetermined level.

One aspect of the present invention provides for a method of installing a retractable horizontal lifeline assembly to a first anchorage structure and to a second anchorage structure. The retractable horizontal lifeline assembly includes a lifeline having a first end, a second end, and an intermediate portion interconnecting the first end and the second end. The second end includes a second connector. A drum has a base and is rotatable. The first end of the lifeline is operatively connected to the drum and the intermediate portion of the lifeline is windable about and paid out from the base. A housing includes a first connector and is configured and arranged to house the drum and the lifeline wound about the base of the drum. A crank is releasably connectable to the drum. The method comprises connecting the first connector of the housing to the first anchorage structure, paying out at least a portion of the lifeline from the drum and the housing, connecting the second connector of the second end of the lifeline to the second anchorage structure, connecting the crank to the drum, and applying a torque to the crank thus rotating the drum, wherein the lifeline reaches a predetermined level of tension and the crank provides indication that the predetermined level of tension has been reached.

BRIEF DESCRIPTION OF THE DRAWINGS

FIG. 10 is a bottom perspective view of a drum of the retractable horizontal lifeline assembly shown in FIG. 1;

FIG. 11 is a side view of the drum of the retractable horizontal lifeline assembly shown in FIG. 10 with a reserve of lifeline;

FIG. 12 is a top perspective view of the drum of the retractable horizontal lifeline assembly with the reserve of lifeline shown in FIG. 11;

FIG. 13 is a perspective view of a portion of the drum of the retractable horizontal lifeline assembly with the reserve of lifeline shown in FIG. 12 showing a connector of the drum;

FIG. 14 is a side view of the drum of the retractable horizontal lifeline assembly shown in FIG. 10 with a lifeline;

FIG. 15 is a top perspective view of the drum of the retractable horizontal lifeline assembly shown in FIG. 10 with a lifeline;

FIG. 16 is a side view of another embodiment retractable horizontal lifeline assembly constructed according to the principles of the present invention with its housing removed;

FIG. 17 is a front perspective view of the retractable horizontal lifeline assembly shown in FIG. 16;

FIG. 21 is a top perspective view of a crank of the retractable horizontal lifeline assembly shown in FIG. 1;

FIG. 22 is a bottom perspective view of the crank shown in FIG. 21 with its handle pivoted inward;

FIG. 30 is a side view of the crank shown in FIG. 28;

FIG. 31 is a bottom view of the crank shown in FIG. 28;

FIG. 32 is a top view of the crank shown in FIG. 28;

FIG. 33 is a top view of the crank shown in FIG. 32 with a housing plate removed;

FIG. 34 is a bottom view of a housing plate of the crank shown in FIG. 28;

FIG. 35 is a cross-section view of the housing plate shown in FIG. 34 taken along the lines 35-35;

DETAILED DESCRIPTION OF A PREFERRED EMBODIMENT

Figure 2:
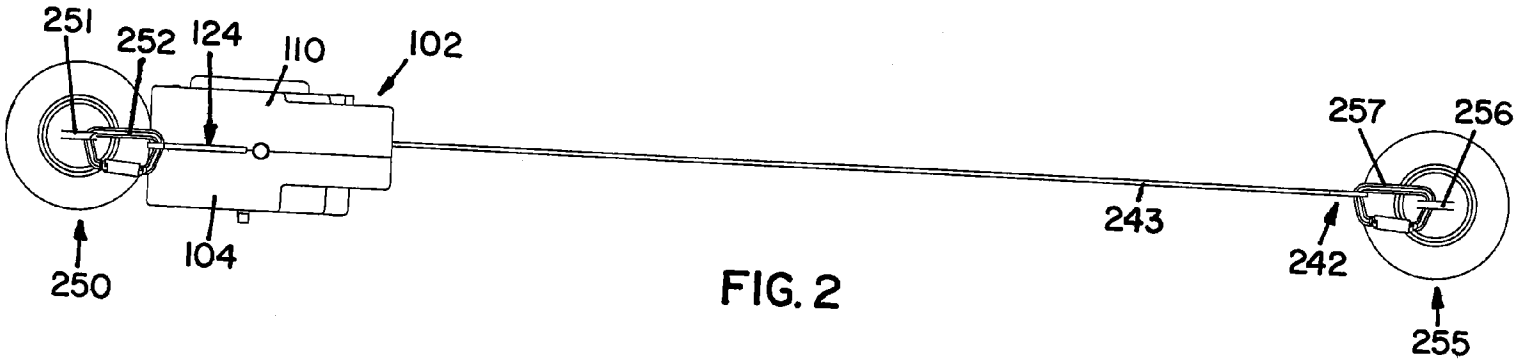
FIG. 2 is a top view of the retractable horizontal lifeline assembly shown in FIG. 1 connected to anchorage structures.

Retractable horizontal lifeline assemblies constructed according to the principles of the present invention are designated by the numeral 100 and by the numeral 300 in the drawings.

The retractable horizontal lifeline assembly 100 includes a housing 102 having a first side 104 and a second side 110. The first side 104 includes a first side plate 105 from which sides 108 extend, and the second side 110 includes a second side plate 111 from which sides 112 extend. The sides 108 correspond with the sides 112, and the first side 104 and the second side 110 form a cavity 113 therebetween in which other components of the retractable horizontal lifeline assembly are housed. The first side plate 105 includes a first aperture 106 proximate the top of the first side plate 105 and a second aperture 107 proximate the middle of the first side plate 105. Proximate the tops of the sides 108 and 112, the sides 108 and 112 have semi-circular notches that cooperate to form a third aperture 114. Proximate the fronts of the sides 108 and 112, the sides 108 and 112 have rectangular notches that cooperate to form a fourth aperture 115.

Figure 5:
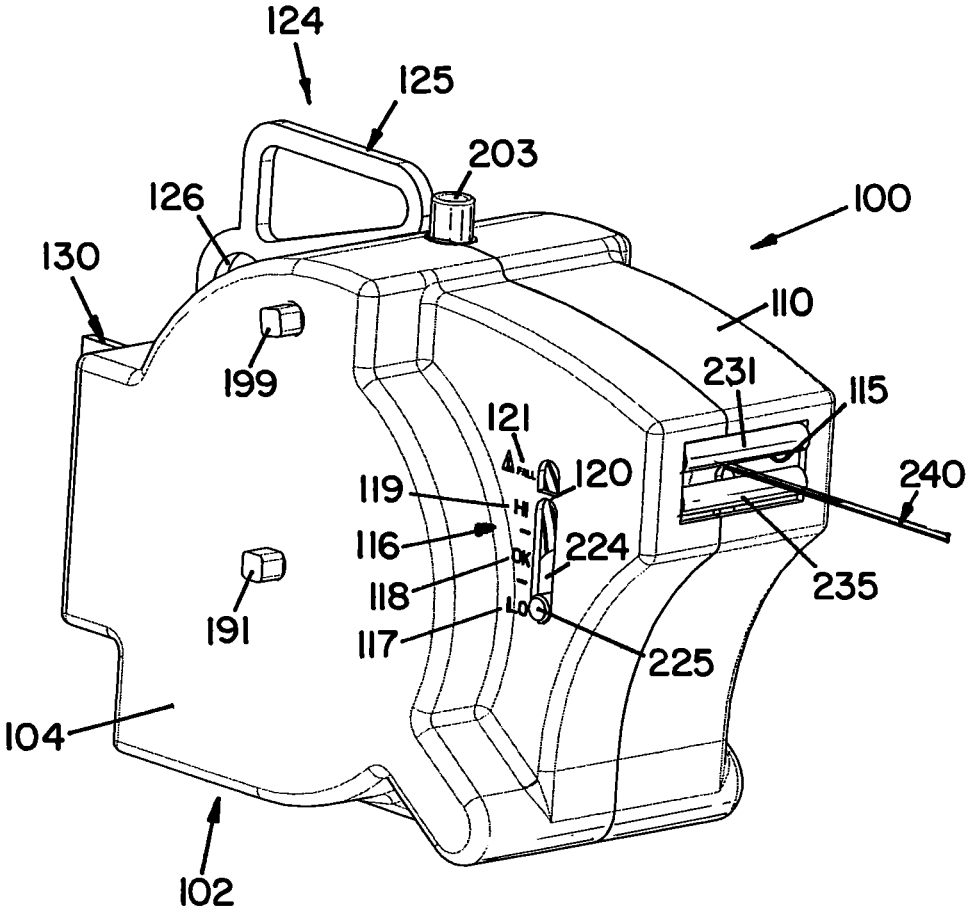
FIG. 5 is a front perspective view of the retractable horizontal lifeline assembly shown in FIG. 1.

The first side plate 105 also preferably includes a window 116 and at least one indication mark proximate the window 116. The window 116 is preferably positioned proximate the front of the housing 102. As shown in FIG. 5, a "LO" tension indicator 117 is proximate the bottom of the window 116, an "OK" tension indicator 118 is proximate the middle of the window 116, and a "HI" tension indicator 119 is proximate the top of the window 116. A bridge 120 extends across the window 116 proximate the "HI" tension indicator 119, and above the bridge 120 is a fall indicator 121 proximate the top of the window 116 above the "HI" tension indicator 119. The housing 102 is preferably made of plastic.

A first connector plate 153 and a second connector plate 167 cooperate within the cavity 113 of the housing 102 as a frame to which other components of the retractable horizontal lifeline assembly 100 are connected. The first connector plate 153 is preferably generally Y-shaped and includes an angled portion 162 from the top of which an upward extending portion 154 and a sideways extending portion 159 extend. The upward extending portion 154 and the sideways extending portion 159 are both preferably T-shaped, the "T" of the upward extending portion 154 being oriented with the top in an upward orientation and the "T" of the sideways extending portion 159 being oriented with the top in a sideways to the left orientation relative to the housing 102. The upward extending portion 154 includes a first aperture 155 proximate the rear of the "T" top, a second aperture 156 proximate the middle of the "T" top, and a third aperture 157 proximate the front of the "T" top relative to the housing 102. A fourth aperture 158 is located between the second aperture 156 and the third aperture 157 and more proximate the top of the upward extending portion 154. The sideways extending portion 159 includes a first aperture 160 proximate the top of the "T" top and a second aperture 161 proximate the bottom of the "T" top. An aperture 163 is positioned proximate the juncture of the portions 154, 159, and 162. The angled portion 162 includes an aperture 164 proximate the distal end.

The second connector plate 167 is preferably similar to and a mirror image of the first connector plate 153 for ease of manufacture, but it is recognized that the second connector plate 167 may be different than the first connector plate 153. The second connector plate 167 is preferably generally Y-shaped and includes an angled portion 176 from the top of which an upward extending portion 168 and a sideways extending portion 173 extend. The upward extending portion 168 and the sideways extending portion 173 are both preferably T-shaped, the "T" of the upward extending portion 168 being oriented with the top in an upward orientation and the "T" of the sideways extending portion 173 being oriented with the top in a sideways to the left orientation relative to the housing 102. The upward extending portion 168 includes a first aperture 169 proximate the rear of the "T" top, a second aperture 170 proximate the middle of the "T" top, and a third aperture 171 proximate the front of the "T" top relative to the housing 102. A fourth aperture 172 is located between the second aperture 170 and the third aperture 171 and more proximate the top of the upward extending portion 168. The sideways extending portion 173 includes a first aperture 174 proximate the top of the "T" top and a second aperture 175 proximate the bottom of the "T" top. An aperture 177 is positioned proximate the juncture of the portions 168, 173, and 176. The angled portion 176 includes an aperture 178 proximate the distal end.

Figure 25:
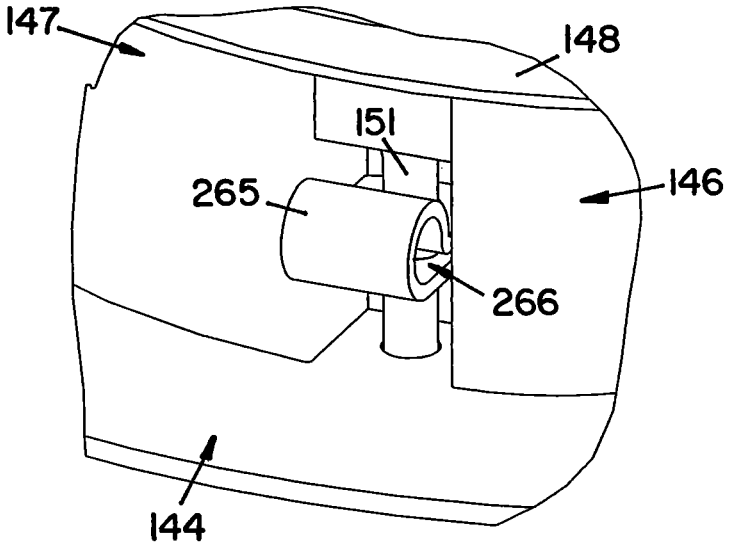
FIG. 25 is a perspective view of a connector of a drum of the retractable horizontal lifeline assembly shown in FIG. 1.

A drum 143, as shown in FIGS. 10-12 and 14-15, includes a cylindrical base 144 with a first side 147 to which a circular plate 148 is connected and a second side 149. A shaft 150 with a bore 150*a* extends through the base 144 proximate the center of the base 144 and extends outward from the second side 149. Preferably, the shaft 150 is integral with the drum 143 and includes a threaded end 150*b* proximate the second side 149. A lifeline 240 is wound about the base 144 and because the drum 143 is rotatable, the lifeline 240 may be paid out from the drum 143 and then wound about the base 144 of the drum 143 when it is no longer being used. The lifeline 240 includes a first end 241, a second end 242, and an intermediate portion 243 interconnecting the first end 241 and the second end 242. The lifeline 240 is preferably up to 60 feet long and made of wire cable, webbing, synthetic rope, or any other suitable material. Preferably, the lifeline 240 is ¼ inch thick. The first end 241 is operatively connected to the drum 143 as is well known in the art, the intermediate portion 243 is windable about the base 144, and the second end 242 includes a loop 242*a* to which a connector 257 may be connected. The base 144 may include optional grooves 145, which help initially guide the intermediate portion 243 about the base 144. Preferably, there are ten grooves 145 to assist in winding the first ten revolutions of lifeline 240 about the base 144. A connector 146, which is preferably a cable tie, may be operatively connected to the base 144 proximate the first side 147. The connector 146 is configured and arranged to be operatively connected to a portion of the intermediate portion 243 a distance from the first end 241, preferably 3 to 4 feet, to create a reserve portion 244 between the connector 146 and the first end 241. As shown in FIG. 25, the connector 146 may be a strap member 265 with apertures 266 at each end, and the base 144 may include a peg 151 extending outward from proximate the first side 147. The strap member 265 is positioned so that the peg 151 is inserted through its apertures 266 to form a loop 267 in the strap member 265. The loop 267 is configured and arranged to cinch about the portion of the intermediate portion 243 thereby preventing the reserve portion 244 from being paid out under normal use. The lifeline 240 may be paid out from the base 144 up to the connector 146 and should a fall occur, the reserve portion 244 is released from the connector 146. Preferably, the connector 146 breaks due to the force of the fall. The drum 143 is preferably made of aluminum.

Figure 20:
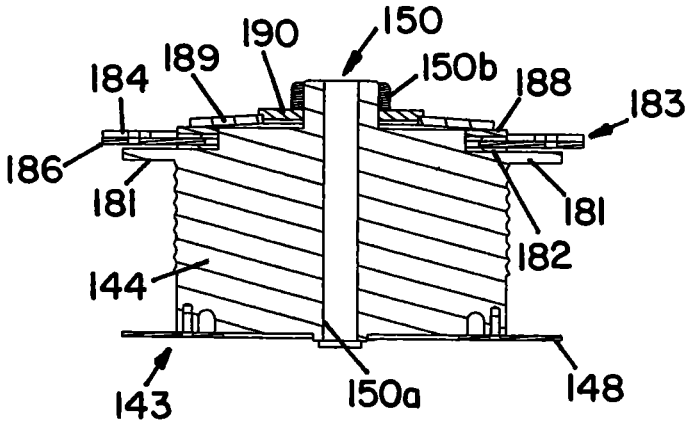
FIG. 20 is a cross sectional view of a brake assembly operatively connected to a drum of the retractable horizontal lifeline assembly shown in FIG. 1.

A brake assembly 180, as shown in FIG. 20, includes a back plate 181, a first friction plate 182, a main plate 183 including a gear disk 184 with teeth 185 and a gear ring 186 with teeth 187, a second friction plate 188, a front plate 189, and a spring disk 190, which are all preferably circular disks having central bores through which the shaft 150 extending outward from the second side 149 of the drum 143 is inserted. The gear ring 186 is operatively connected, preferably with rivets or by welding, to the gear disk 184 and because it is a ring rather than a plate, it provides added thickness to the teeth 185 of the gear disk 184 without adding too much weight to the main plate 183. The back plate 181 is placed proximate the second side 149 of the drum 143 and is preferably secured thereto with a fastener such as a screw. A nut 192 is operatively connected to the threaded end 150*b* of the shaft 150 to secure the brake assembly components to the shaft 150. The spring disk 190, the front plate 189, the second friction plate 188, the main plate 183 (including the gear ring 186 and the gear disk 184), the first friction plate 182, and the back plate 181 are compressed together between the nut 192 and the drum 143, and the spring disk 190 is adjusted to a desired calibrated force by the nut 192 as is well known in the art. The brake assembly 180 is proximate the second side 149 of the drum 143, and the brake assembly 180 and the drum 143 are positioned between the connector plates 153 and 167. Preferably, the first connector plate 153 is proximate the brake assembly 180 and the second connector plate 167 is proximate the first side 147 of the drum 143. The brake assembly 180 is an example of a suitable brake assembly and it is recognized that other brake assemblies known in the art may be used.

A shaft 193 extends through aperture 163 of the first connector plate 153, through the bore 150*a* of the shaft 150, and through aperture 177 of the second connector plate 167 to operatively connect the drum 143 and the brake assembly 180 between the connector plates 153 and 167. A bushing 194 is preferably positioned between each end of the shaft 193 and the corresponding connector plates 153 and 167 to reduce the friction between the shaft 193 and the connector plates 153 and 167. The bushing 194 may be made of plastic, brass, or any suitable material. A second male connector 191 is operatively connected to the shaft 193 and extends through aperture 163 in the first connector plate 153 and aperture 107 in the housing 102 and is used to wind the lifeline 240 about drum 143. Preferably, the second male connector 191 is integral with the end of the shaft 193.

Figure 6:
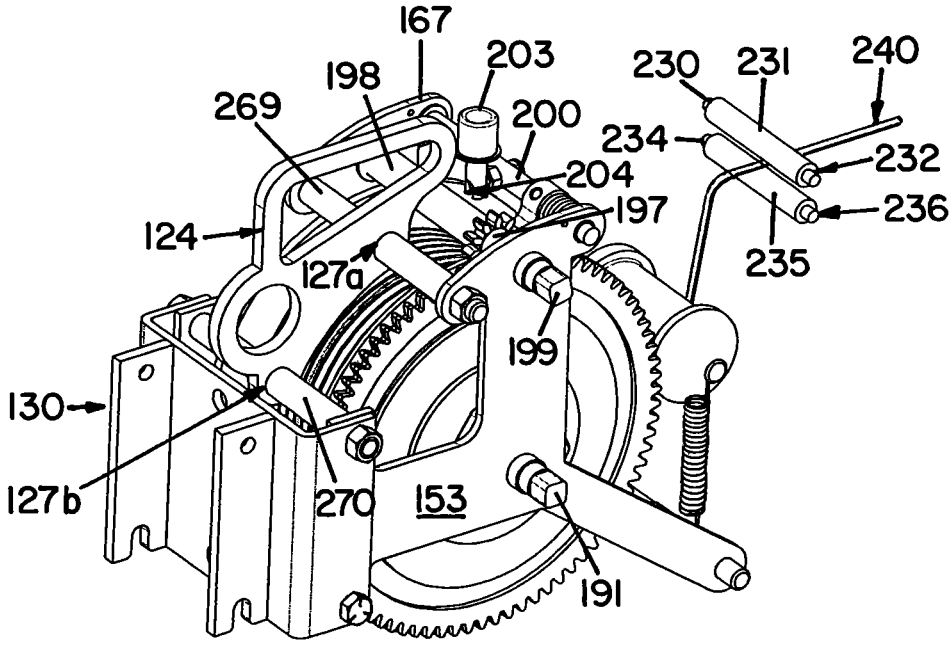
FIG. 6 is a rear perspective view of the retractable horizontal lifeline assembly shown in FIG. 1 with its housing removed.
Figure 8:
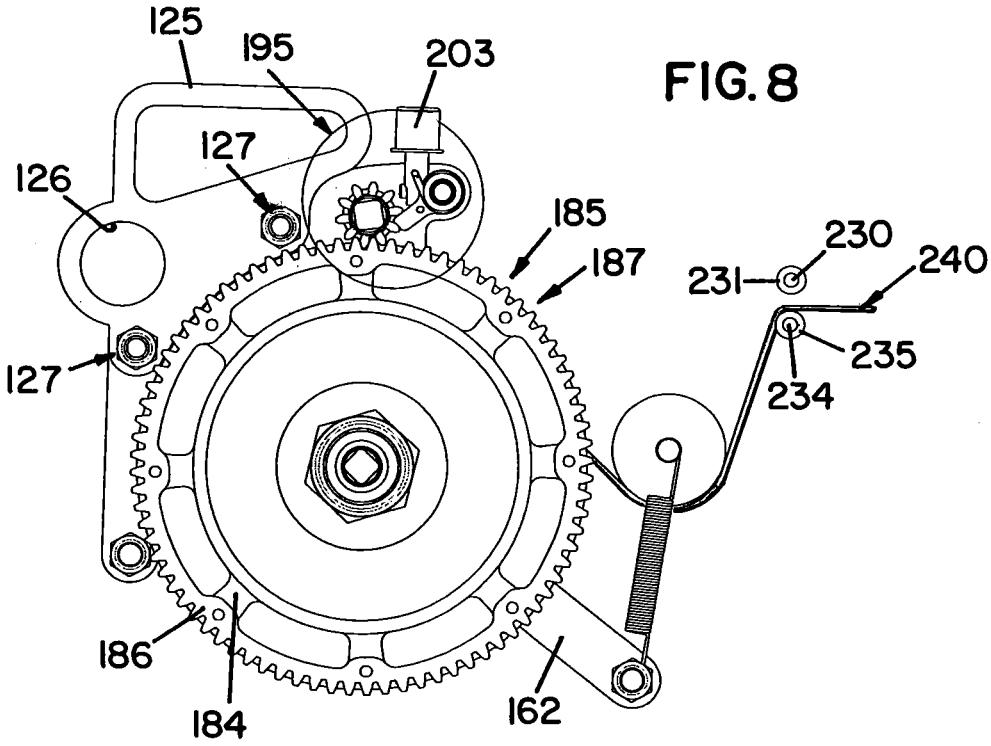
FIG. 8 is a side view of a brake assembly, a locking assembly, and a tension and fall indictor assembly of the retractable horizontal lifeline assembly shown in FIG. 1.
Figure 9:
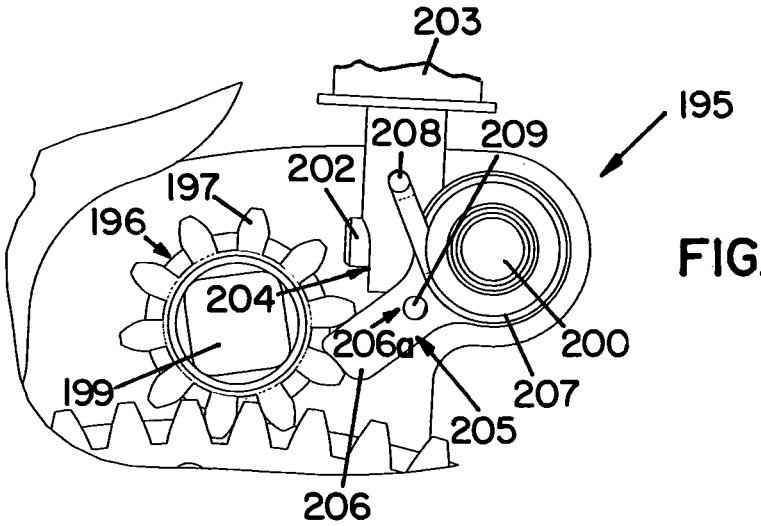
FIG. 9 is a side view of the locking assembly shown in FIG. 8.
Figure 18:
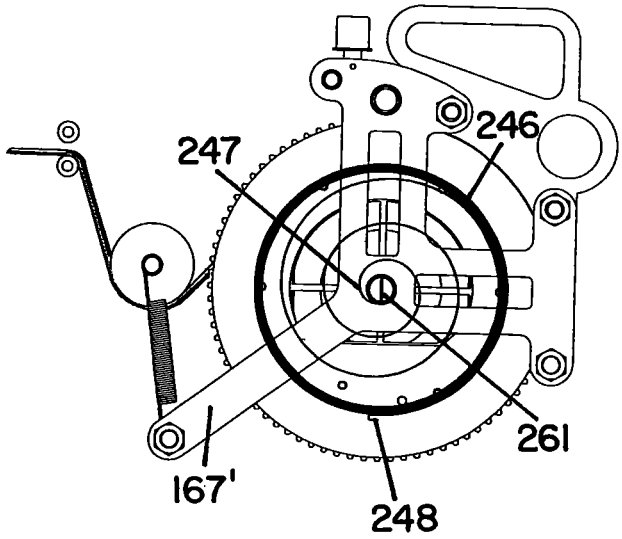
FIG. 18 is a side view of the retractable horizontal lifeline assembly shown in FIG. 16 with its motor spring housing removed.
Figure 19:
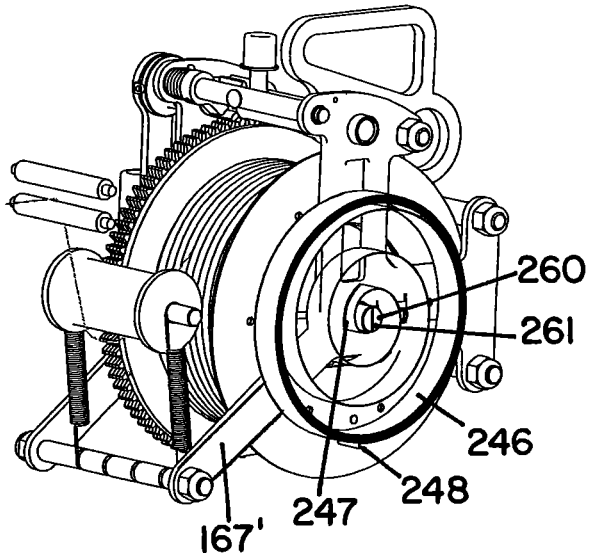
FIG. 19 is a front perspective view of the retractable horizontal lifeline assembly shown in FIG. 16 with its motor spring housing removed.

A locking assembly 195, as shown in FIGS. 6 and 8-9, includes a pinion gear 196 with teeth 197, which cooperate and mate with the teeth 185 and 187 of the main plate 183 of the brake assembly 180. The pinion gear 196 is operatively connected to a shaft 198 so as the shaft 198 rotates, the pinion gear 196 rotates and vice versa. Further, as the main plate 183 rotates, the pinion gear 196 rotates and vice versa. The shaft 198 extends through apertures 156 and 170 of the connector plates 153 and 167, respectively. A first male connector 199 is operatively connected to an end of the shaft 198 proximate the pinion gear 196, and the first connector plate 153 is positioned between the pinion gear 196 and the first male connector 199, which extends through aperture 106 of the housing 102 and is used to tension the lifeline 240. Preferably, the first male connector 199 is integral with the end of the shaft 198.

A shaft 200 is parallel to the shaft 198 and extends through apertures 157 and 171 of the connector plates 153 and 167, respectively, and is pivotal therethrough. A pawl 205 has a bore (not shown) through which the shaft 200 is inserted, and the pawl 205 is proximate the first connector plate 153. The pawl 205 is preferably secured to the shaft 200 with a fastener. The pawl 205 also has an extension portion 206 extending outward proximate the bore, and the extension portion 206 has an aperture 206*a* proximate the bore. A torsion spring 207 is wound about the shaft 200 and is placed between the pawl 205 and the first connector plate 153. A first end 208 of the torsion spring 207 is inserted through the aperture 158 of the first connector plate 153, and a second end 209 of the torsion spring 207 is inserted through the aperture 206*a* of the pawl 205. The pawl 205 and the shaft 200 pivot together within the apertures 157 and 171 and the torsion spring 207 places a force upon the pawl 205 so that the extension portion 206 is urged in a downward direction to engage the teeth 197 of the pinion gear 196 thereby locking the drum 143 and preventing rotation of the drum 143 in a clockwise direction. The pawl 205 automatically locks the pinion gear 196, allowing the pinion gear 196 to be rotated in a clockwise direction and preventing the pinion gear 196 from being rotated in a counterclockwise direction. The pawl 205 has an engaging position and a releasing position. The engaging position sufficiently engages the teeth 197 of the pinion gear 196 to prevent the pinion gear 196 from rotating in a counterclockwise direction, and the releasing position does not sufficiently engage the teeth 197 thereby allowing the pinion gear 196 to be rotated in a clockwise direction. The direction of the rotation as described herein is relative to the embodiment as shown in FIG. 8, and it is recognized that the direction of rotation may change as the embodiment or the orientation of the embodiment changes.

The pinion gear 196 can be rotated in a clockwise direction and the teeth 197 push the pawl 205 downward away from the pinion gear 196 overcoming the force of the torsion spring 207 thereby allowing the pinion gear 196 to rotate in a clockwise direction. The torsion spring 207 continually places force on the pawl 205 that must be overcome to rotate the pinion gear 196. The pawl 205 creates a mechanical stop of the pinion gear 196 when the pinion gear 196 is rotated in a counterclockwise direction. This assists in tensioning the lifeline 240 because the drum can rotate in a counterclockwise direction but it cannot rotate in a clockwise direction while the pawl 205 engages the pinion gear 196.

The shaft 200 also includes a bore 201 extending axially through the shaft 200 proximate the pawl 205 through which a connector 202 extends through perpendicularly from the shaft 200. A push button 203 includes a notch 204 that straddles the connector 202, and the push button 203 extends through the third aperture 114 formed by the sides 104 and 110 of the housing 102. Because the pawl 205 is biased by the torsion spring 207, the shaft 200 is also biased by the torsion spring 207. When the push button 203 is pressed downward, the connector 202 is pushed downward, which rotates the shaft 200 in a counterclockwise direction thereby also rotating the pawl 205 in a counterclockwise direction, overcoming the force of the torsion spring 207, to release the teeth 197 of the pinion gear 196. The push button 203 is a release mechanism may be used to unlock the drum 143 to pay out the lifeline 240, to rewind the lifeline 240, and to release tension in the lifeline 240. The pinion gear 196 is automatically locked due to the torsion spring 207 placing a force upon the pawl 205 thereby automatically locking the main gear 183 of the brake assembly 180. The push button may be plastic, aluminum, or any other suitable material.

As shown in FIGS. 21 and 22, a crank 211 includes an arm 212 with a first end 213 having an aperture (not shown) through which a fastener 213*a* extends to pivotally operatively connect a handle 214 thereto. A hinge 214*a* allows the handle 214 to be pivoted inward toward the arm 212 when not in use. A pocket (not shown) may be operatively connected to or integral with the housing 102 and the crank 211 may be placed therein when not in use. A second end 215 of the arm 212 includes a swivel 216 between the arm 212 and a female connector 217 having a receiver 218. Fasteners 219 connect the swivel 216 and the female connector 217 to the second end 215. The swivel rotates between the arm 212 and the female connector 217 and is configured and arranged to be operatively connected to a connector (not shown) such as a rope or a chain interconnecting the crank 211 and the housing 102. The connector ensures that the crank 211 is not dropped or lost, and the swivel 216 allows the crank 211 to function without interference from the connector because as the arm 212 is rotated about either of the male connectors 191 or 199, the swivel does not rotate thereby keeping the connector from interfering with the rotation of the arm 212. The receiver 218 is configured and arranged to receive the first male connector 199 operatively connected to the shaft 198 of the locking assembly 195 and the second male connector 191 operatively connected to the shaft 193. When the crank 211 is operatively connected to the first male connector 199, the lifeline 240 may be tensioned.

The pawl 205 automatically locks the pinion gear 196, allowing the pinion gear 196 to be rotated in a clockwise direction and preventing the pinion gear 196 from being rotated in a counterclockwise direction. This allows the lifeline 240 to be tensioned incrementally as the crank 211 turns the first male connector 199. The interaction between the gear disk 184 and the pinion gear 196 allows the lifeline 240 to be tensioned with less effort due to the mechanical advantage provided by the preferred 8.5:1 gear ratio between the main plate 183 and the pinion gear 196. When the crank 211 is operatively connected to the second male connector 191 and the pinion gear 196 has been released from the pawl 205, the lifeline 240 may be rewound about the base 144.

Figure 7:
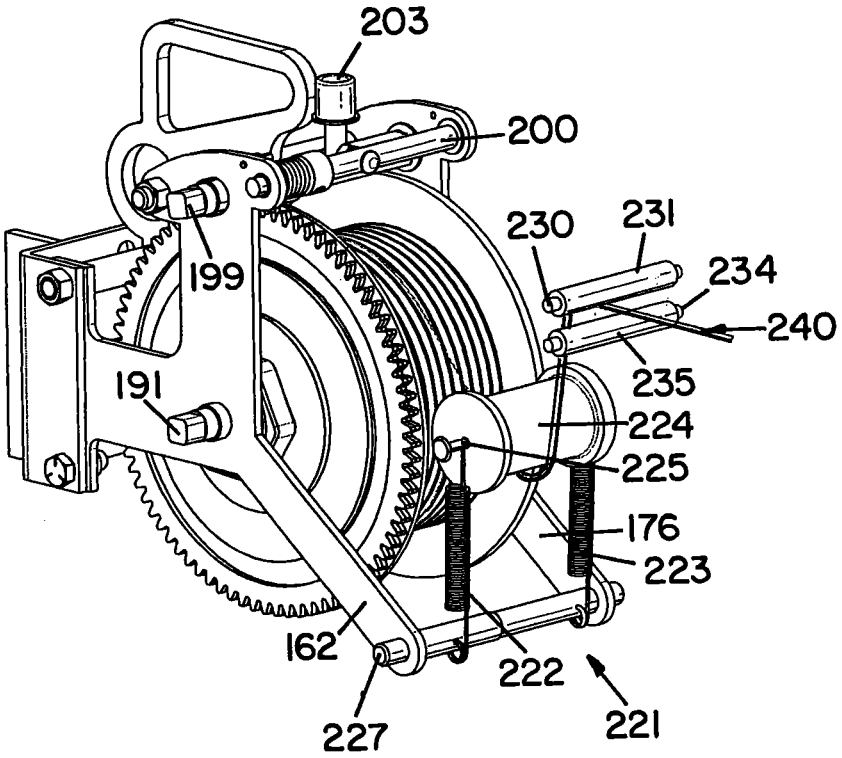
FIG. 7 is a front perspective view of the retractable horizontal lifeline assembly shown in FIG. 1 with its housing removed.

A tension and fall indicator assembly 221, as shown in FIG. 7, includes a cylindrical roller 224 having a first connector 225 at one end and a second connector 226 at its opposite end. The connectors 225 and 226 are preferably pegs extending longitudinally outward from the ends of the roller 224. The first connector 225 extends through the window 116 of the housing 102. A third connector 227 is a shaft that extends through apertures 164 and 178 of the connector plates 153 and 167. A first biasing member 222 is preferably an extension spring that interconnects the first connector 225 and the third connector 227, and a second biasing member 223 is preferably an extension spring that interconnects the second connector 226 and the third connector 227. Although two biasing members are shown and described, it is recognized that any suitable number of biasing members may be used. Further, although extension springs are shown and described, it is also recognized that torsion springs, compression springs, disk springs, elastic members, and other types of suitable biasing members may be used. The biasing members 222 and 223 place a force upon the roller 224 that urges the roller 224 downward toward the third connector 227.

A first shaft 230 extends through a bore 232 of a first roller 231, which is proximate the top of the aperture 115 formed by the sides 104 and 110 of the housing 102. The shaft 230 and the roller 231 could also be integral. A second shaft 234 extends through a bore 236 of a second roller 235, which is proximate the bottom of the aperture 115 formed by the sides 104 and 110 of the housing 102. The shaft 234 and the roller 235 could also be integral. The shafts 230 and 234 correspond with indentations in the sides 104 and 110 of the housing 102 proximate the top and the bottom of the aperture 115 so that the shafts 230 and 234 are secured therein between the sides 104 and 110. The rollers 231 and 235 pivot about the shafts 230 and 234, respectively, as the lifeline 240 is paid out of the housing 102 and wound back up into the housing 102 to assist in preventing wear on the housing 102 and on the lifeline 240.

Figure 1:
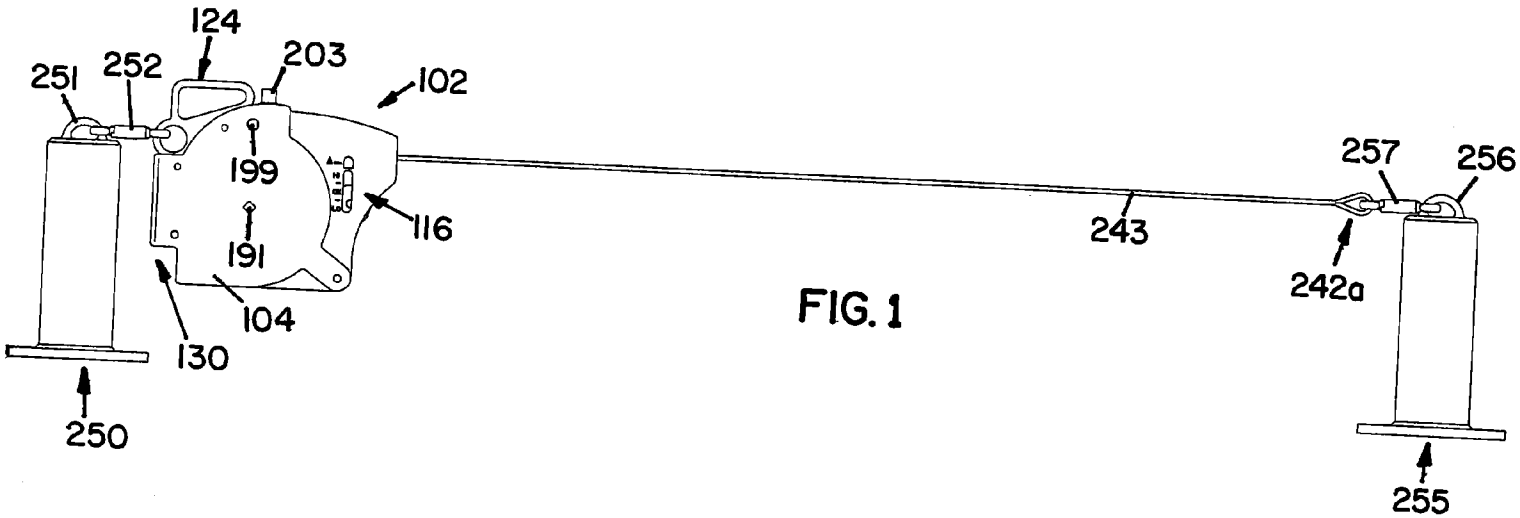
FIG. 1 is a side view of a retractable horizontal lifeline assembly constructed according to the principles of the present invention connected to anchorage structures.
Figure 3:
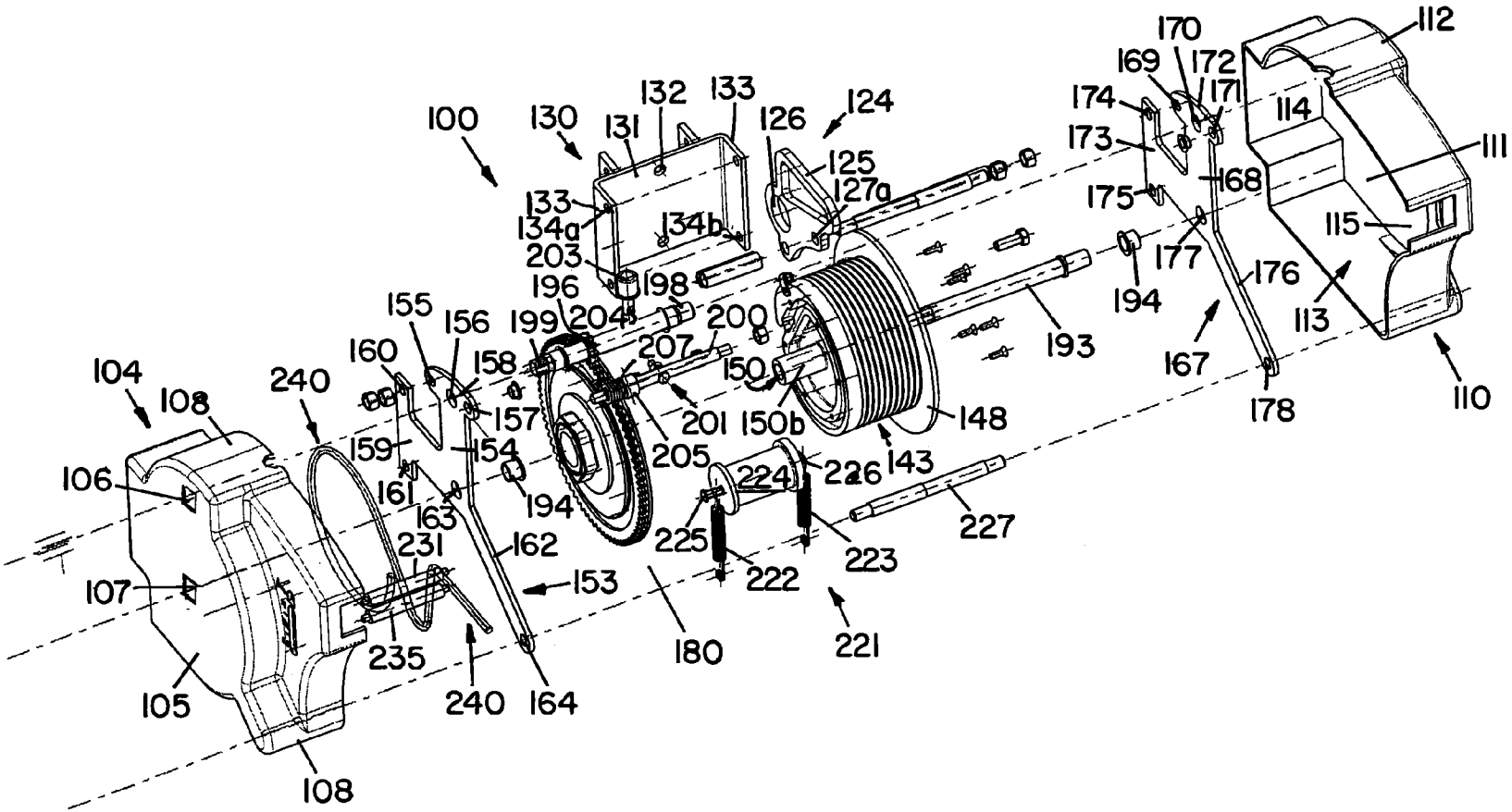
FIG. 3 is an exploded perspective view of the retractable horizontal lifeline assembly shown in FIG. 1.
Figure 4:
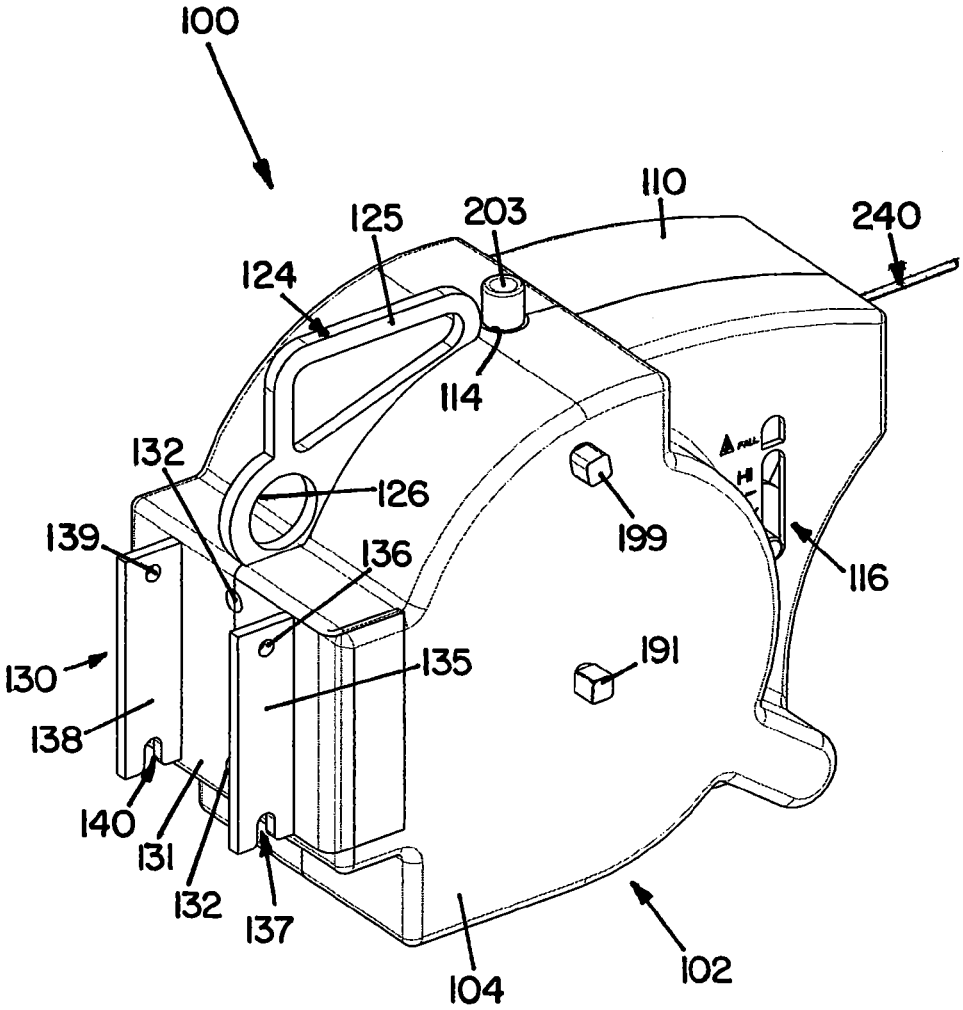
FIG. 4 is a rear perspective view of the retractable horizontal lifeline assembly shown in FIG. 1.

Extending outward from the housing 102 are a first anchorage member 124 and a second anchorage member 130, which provide two options for anchoring the rear of the retractable horizontal lifeline assembly 100 as shown in FIGS. 1 and 2. The first anchorage member 124 extends outward proximate the top and the rear of the housing 102 between the sides 104 and 110. The first anchorage member 124 is a plate-like member forming a handle 125 proximate the top and forming an aperture 126 proximate the rear. The handle 125 may be used to carry the retractable horizontal lifeline assembly 100. Alternatively, a handle may be incorporated into the housing. A connector 252 such as a carabiner, a snap hook, or any other suitable connector may be inserted through the aperture 126 for connecting the retractable horizontal lifeline assembly 100 to a connector member 251 of an anchorage structure 250. An aperture 127*a* is proximate the bottom and the handle 125, and an aperture 127*b* is proximate the bottom and the aperture 126. The first anchorage member 124 is preferably made of steel.

The second anchorage member 130, which may be an optional feature, is a U-shaped member having a base plate 131 with side plates 133 extending outward perpendicularly from opposing sides of the base plate 131 toward the front of the retractable horizontal lifeline assembly 100 thus forming a U-shape. The base plate 131 includes apertures 132, preferably one aperture 132 proximate the top of the base plate 131 and one aperture 132 proximate the bottom of the base plate 131. Each of the side plates 133 includes apertures 134*a* and 134*b*, aperture 134*a* proximate the top of the side plate 133 and aperture 134*b* proximate the bottom of the side plate 133. A first flange 135 extends outward perpendicularly from the base plate 131 between the apertures 132 and a side plate 133 toward the rear of the retractable horizontal lifeline assembly 100. The first flange 135 includes an aperture 136 proximate the top of the first flange 135 and a notch 137 proximate the bottom of the first flange 135. A second flange 138 extends outward perpendicularly from the base plate 131 between the apertures 132 and the other side plate 133 toward the rear of the retractable horizontal lifeline assembly 100. The second flange 138 includes an aperture 139 proximate the top of the second flange 138 and a notch 140 proximate the bottom of the second flange 138. The second anchorage member 130 may be used to connect to an anchorage structure such as brackets, stanchions, I-beams, posts, and other suitable structures well known in the art. The second anchorage member 130 is preferably made of steel.

Figure 24:
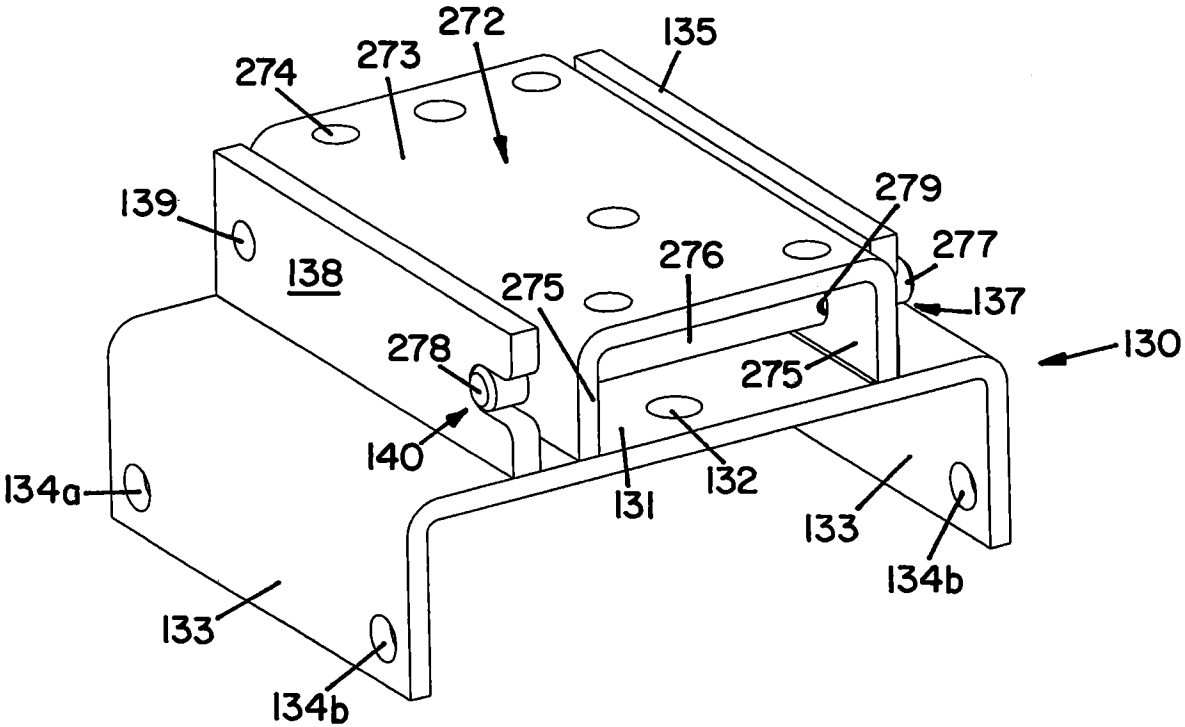
FIG. 24 is a perspective view of an anchorage connector of the retractable horizontal lifeline assembly shown in FIG. 1 operatively connected to a bracket.

An example of a suitable bracket 272 to which the second anchorage member 130 may be attached is shown in FIG. 24. Such a bracket 272 is commonly operatively connected to tripods, davit arms, and other portable safety anchorage devices such as those sold by D B Industries, Inc. of Red Wing, Minn. The bracket 272 is preferably a U-shaped member having a base plate 273 with side plates 275 extending outward perpendicularly from opposing sides of the base plate 273 outward from the portable safety anchorage device to which it is operatively connected. The side plates 275 of the bracket 272 fit between the flanges 135 and 138 of the second anchorage member 130. The base plate 173 includes a plurality of apertures 274 through which fasteners are inserted to operatively connect the bracket 272 to the portable safety anchorage device. The side plates 275 include apertures (not shown) proximate the top and apertures 279 proximate the bottom. A shaft 276 includes a first end 277 and a second end 278 that extend through the apertures 279.

As shown in FIG. 6, the anchorage members 124 and 130 are operatively connected to the connector plates 153 and 167 and extend outward through the housing 102 between the sides 104 and 110. A rod 269 extends through aperture 155 of the first connector plate 153, through aperture 127*a* of the first anchorage member 124, and through aperture 169 of the second connector plate 167 and each end of the rod 269 is secured with fasteners. A rod 270 extends through aperture 134*a* of the side plate 133, through aperture 160 of the first connector plate 153, through aperture 127*b* of the first anchorage member 124, through aperture 174 of the second connector plate 167, and through aperture 134*a* of the side plate 133 and each end of the rod 270 is secured with fasteners. A fastener is inserted through aperture 134*b* of the side plate 133 and through aperture 161 of the first connector plate 153, and a fastener is inserted through aperture 134*b* of the other side plate 133 and through aperture 175 of the second connector plate 167.

Figure 23:
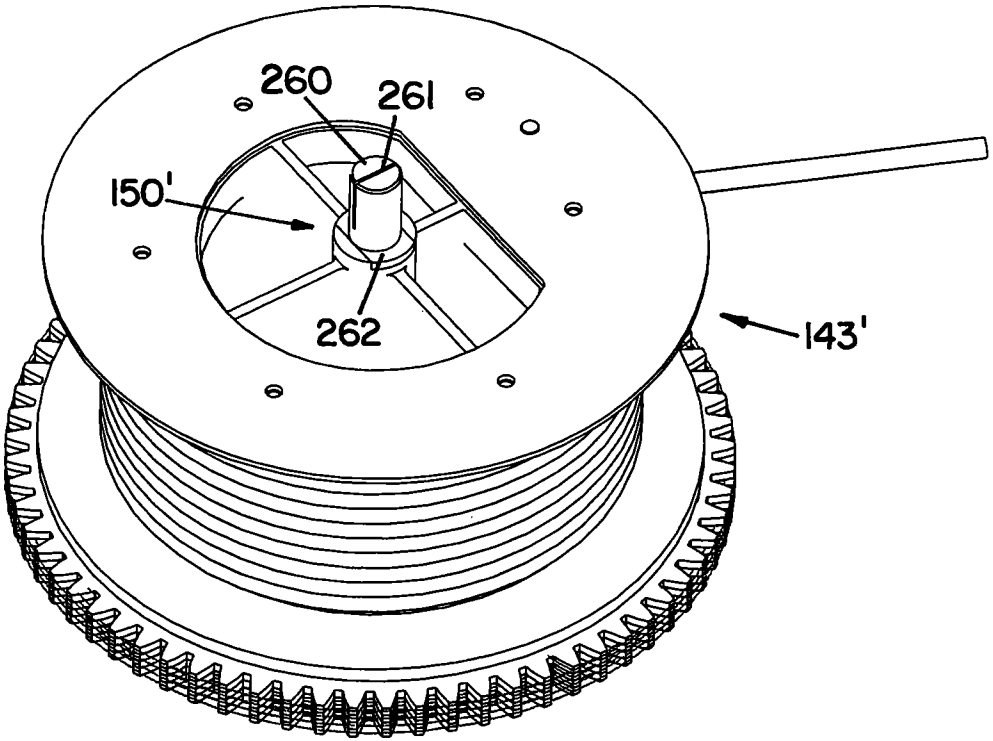
FIG. 23 is a perspective view of a drum of the retractable horizontal lifeline assembly shown in FIGS. 18 and 19.

Optionally, as shown in FIGS. 16-19, a motor spring housing 245 operatively connected to the second connector plate 167' houses a motor spring 246 having a first end 147 and a second end 248. As shown in FIG. 23, a shaft 260 includes a slot 261 proximate one end, a flange 262 extending outward proximate the middle, and a male connector (not shown) proximate the opposite end. The male connector (not shown) is inserted into a bore (not shown) of the shaft 150' of the drum 143'. The end including the slot 261 is inserted through an aperture (not shown) in the second connector plate 167'. Therefore, the shaft 260 is sandwiched between the drum 143' and the second connector plate 167'. The first end 247 of the motor spring 246 is inserted into the slot 261 in the shaft 260 and the second end 248 is operatively connected to the motor spring housing 245 such as by a fastener as is well known in the art. The motor spring may also be operatively connected to the drum and to the housing by other suitable means well known in the art. The motor spring 246 places a force upon the drum thereby rotating the drum when tension is released from the lifeline thereby automatically winding the lifeline about the drum. The motor spring 246 winds more tightly as the lifeline is paid out from the drum, and because the motor spring wants to unwind, when tension is released from the lifeline, the motor spring unwinds thus automatically winding the lifeline about the drum.

The lifeline 240 is preferably routed from the rear toward the front and over the top of the drum 143 and then the lifeline 240 extends downward toward the roller 224. The lifeline 240 is routed between the roller 224 and the third connector 227 and then between rollers 231 and 235 out of the housing 102.

The retractable horizontal lifeline assembly of the present invention is a temporary and a portable system that is easily installed, uninstalled, and transportable because it is self-contained and relatively light weight. The lifeline is stored in the housing and the user simply carries the retractable horizontal lifeline assembly by the handle to a desired location.

FIGS. 1 and 2 show the retractable horizontal lifeline assembly 100 operatively connected to a first anchorage structure 250 including a connector member 251 and to a second anchorage structure 255 including a connector member 256. A connector 252 such as a carabiner, a snap hook, a shackle, or any other suitable connector may be used to interconnect the connector member 251 and the first anchorage member 124 through the aperture 126. Alternatively, the second anchorage member 130 may be operatively connected to an anchorage structure such as brackets, stanchions, I-beams, posts, and other suitable structures as is well known in the art. To connect the second anchorage member 130 to the bracket 272, the ends 277 and 278 of the bracket's shaft 276 are slid into the notches 137 and 140, respectively, with the base plate 273 and the side plates 275 between the flanges 135 and 138. A pin (not shown) is inserted through the apertures 136 and 139 of the second anchorage member 130 and the top apertures (not shown) of the bracket 272. Alternatively, apertures 132 could be used to connect other types of brackets operatively connected to a safety device with fasteners as is well known in the art. The second end 242 of the lifeline 240 is then pulled away from the housing 102 thereby paying out the lifeline 240 from the drum 143 and the housing 102. A connector 257 such as a carabiner, a snap hook, or any other suitable connector may be used to interconnect the connector member 256 and the loop 242*a* of the second end 242 of the lifeline 240.

In order to function properly and safely arrest a fall, the lifeline 240 must be properly tensioned. The crank 211 is operatively connected to the first male connector 199 by inserting the first male connector 199 into the receiver 218. The handle 214 is turned thus rotating the first male connector 199, which in turn rotates the shaft 198 thereby rotating the pinion gear 196, which in turn rotates the gear disk 184 thereby rotating the drum 143 to wind the lifeline 240 more tightly about the base 144. As shown in FIG. 6, the pinion gear 196 is rotated clockwise causing the pawl 205 to pivot downward releasing the teeth 197 of the pinion gear 196. Because the pawl 205 is biased by the torsion spring 207, the pawl 205 is biased so that it will pivot upward to engage the teeth 197 of the pinion gear 196. When rotation of the pinion gear 196 stops, the pawl 205 will pivot upward to engage the teeth 197 thereby locking the mechanism and preventing additional lifeline 240 from being paid out.

As the lifeline 240 becomes more and more taut, the roller 224 will rise. The first connector 225 will likely start out being positioned proximate the "LO" tension indicator 117 and as the lifeline 240 is tensioned, the lifeline 240 becomes more taut and raises the roller 224 thus raising the first connector 225 upward relative to the window 116 of the housing 102. When the first connector 225 is positioned proximate the "OK" tension indicator 118, the lifeline 240 is properly tensioned and the crank can be removed from the first male connector 199. Should a fall occur, the lifeline 240 pulls upward on the roller 224 and the first connector 225 extending through the window 116 moves upward with the roller 224 and breaks the bridge 120 thereby indicating that a fall has occurred.

To release the tension on the lifeline 240, for example when it is desired to disconnect the second end 242 of the lifeline 240 from the anchorage structure, the push button 203 is pressed, which pivots the shaft 200 thereby pivoting the pawl 205 downward to release the teeth 197 of the pinion gear 196. The crank 211 may then be operatively connected to the second male connector 191 by inserting the second male connector 191 into the receiver 218. The handle 214 is then turned thus rotating the second male connector 191, which in turn rotates the shaft 150 thereby rotating the drum 143 in a counter-clockwise direction to wind the lifeline 240 about the base 144. If the motor spring 246 is used, when the push button 203 is pressed, thereby unlocking the pinion gear 196, the motor spring 246 will rotate the drum 143 to automatically wind the lifeline 240 about the base 144.

Should a fall occur, the weight of the user(s) exerts force on the lifeline 240 forcing the drum 143 to rotate and pay out a few feet of the lifeline 240, preferably two turns of the drum 143, but because the main plate 183 of the brake assembly 180 is fixed due to the locking assembly 195, the brake assembly 180 absorbs energy from the force of the fall and also limits the load on the anchorage structures. Without the reserve portion 244 of the lifeline 240, when the entire available length of the lifeline 240 is paid out, there is no additional lifeline 240 to allow the drum 143 to rotate so the brake assembly 180 would not become activated and the impact of the fall would seriously injure the user. The reserve portion 244 is only released in the event of a fall, which causes the connector 146 to release the reserve portion 244, not during normal use such as when the user pays out the lifeline 240 during installation of the system.

Figure 37:
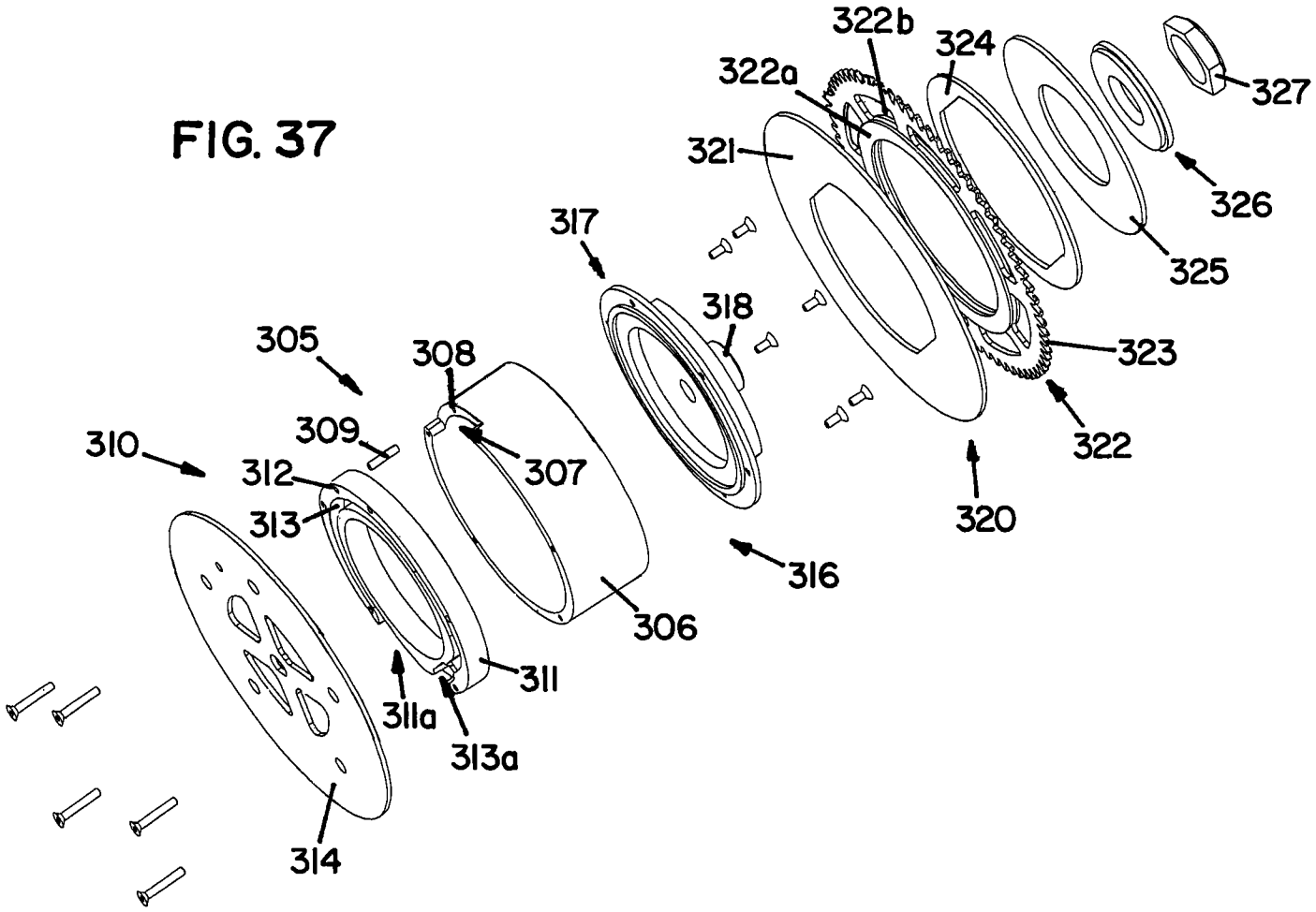
FIG. 37 is an exploded perspective view of a drum and a brake assembly of the retractable horizontal lifeline assembly shown in FIG. 27.

It can be seen that the retractable horizontal lifeline assembly 300 is similar to the retractable horizontal lifeline assembly 100, and the following will be a description of components of the assembly 300 that include more substantive differences from the assembly 100. The retractable horizontal lifeline assembly 300 includes a housing 302 in which a drum 305 is positioned. As shown in FIG. 37, the drum 305 includes a cylindrical base 306. Proximate a first side 310, the base 306 includes a notch 307 and a laterally extending aperture 308 in the base 306 proximate the middle of the notch 307. An extension portion 311 is positioned proximate the first side 310 of the base 306 and includes a laterally extending aperture 312 in alignment with the aperture 308. An end of a connector 309, which is preferably a rod, is configured and arranged to fit within the aperture 308 and the other end of the connector 309 is configured and arranged to fit within the aperture 312 so that a middle portion of the connector 309 spans the notch 307. The side of the extension portion 311 opposite the base 306 includes a channel 313 configured and arranged to receive an end portion of the lifeline 540. The channel 313 does not extend entirely around the side of the extension portion 311. One end of the channel 313 includes a notch 313*a* and the other end of the channel 313 terminates proximate an opening 311*a* in the extension portion 311. The opening 311*a* is between the notch 313*a* and the other end of the channel 313. A swaged cable stop (not shown) is operatively connected to the end of the lifeline 540 and inserted into the notch 313*a* proximate an end of the channel 313. The lifeline 540 is routed through the channel 313 and extends outward through the opening 311*a* so that a portion of the lifeline 540 can be wound around the extension portion 311 to create a reserve portion 541 of the lifeline 540. The reserve portion 541 is proximate the portion of the lifeline 540 that extends outward through the opening 311*a*, wound about the extension portion 311, and threaded underneath the connector 309 and through the notch 307. During normal use, the connector 309 acts as a stop preventing the reserve portion 541 from being paid out. However, should a fall occur, the connector 309 breaks thus allowing the reserve portion 541 to be paid out, which assists in reducing the forces from the fall transferred to the user. The portion of the lifeline 540 within the channel 313 is used to connect the end of the lifeline 540 to the extension portion 311 of the drum 305 and does not get paid out from the drum 305, even when the reserve portion 541 is paid out.

A circular plate 314 is positioned proximate the extension portion 311 thus sandwiching the extension portion 311 between the base 306 and the plate 314. The circular plate 314, the extension portion 311, and the base 306 include corresponding apertures through which fasteners, preferably screws, extend to secure these components together proximate the first side 310. The circular plate 314 assists in securing the end of the lifeline 540 within the channel 313. A circular plate 317 is placed proximate a second side 316 and includes a hub 318 extending outward from the side opposite the base 306. The circular plate 317 and the base 306 include corresponding apertures through which fasteners, preferably screws, extend to secure these components together proximate the second side 316.

Figure 39:
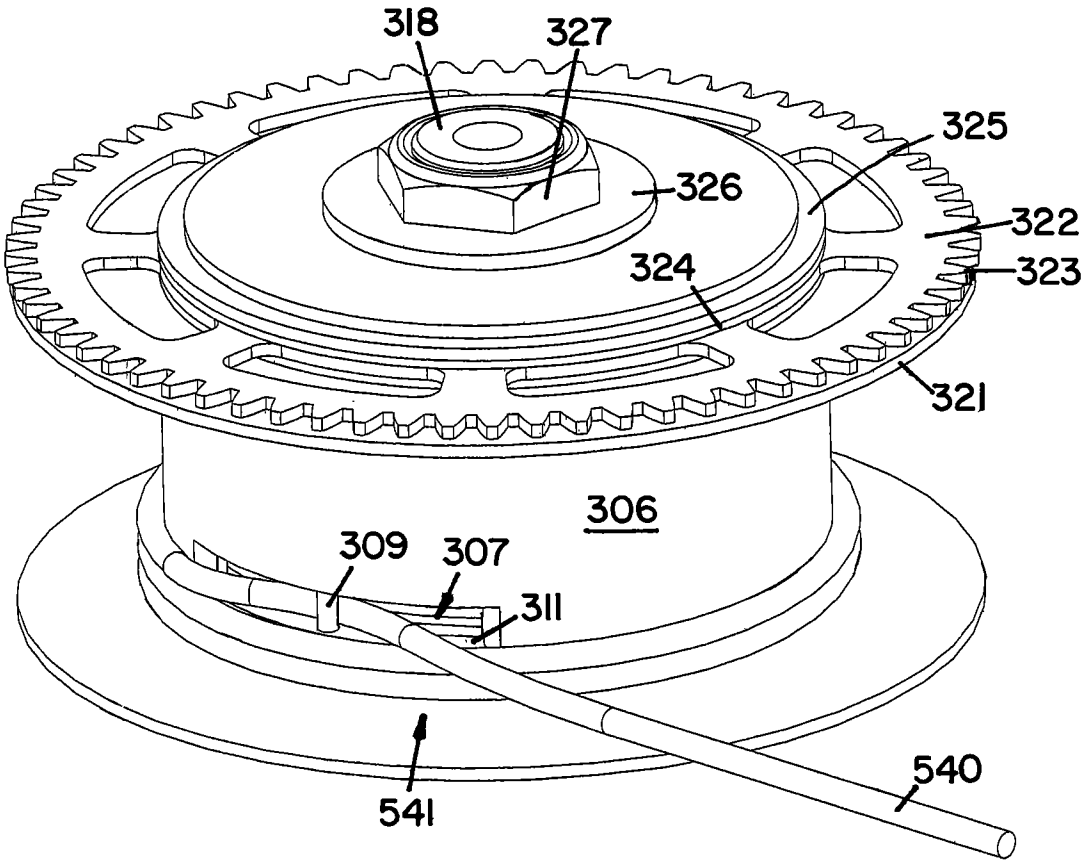
FIG. 39 is a perspective view of the drum and the brake assembly shown in FIG. 37 with a reserve portion of lifeline.

A brake assembly 320, as shown in FIGS. 37 and 39, is operatively connected to the plate 317 and the hub 318 extends through the brake assembly 320. The brake assembly 320 includes a flange 321, a gear disk 322 with teeth 323, a pressure plate 324, a spring disk 325, a spacer 326, and a nut 327 securing the brake assembly 320 to the hub 318. The gear disk 322 includes a first friction plate 322*a* operatively connected to a first side and a second friction plate 322*b* operatively connected to a second side. The spacer 326, the spring disk 325, the pressure plate 324, the gear disk 322 (including the teeth 323), and the flange 321 are compressed together between the nut 327 and the plate 317. The spring disk 325 is adjusted to a desired calibrated force by the nut 327 as is well known in the art. The spacer 326 assists in providing even pressure on the spring disk 325 by the nut 327. The brake assembly 320 is an example of a suitable brake assembly and it is recognized that other brake assemblies known in the art may be used. The hub 318 includes a bore through which a shaft 329 extends. A second male connector 330 is operatively connected to the shaft 329, and the second male connector 330 extends outward from the housing 302.

Figure 38:
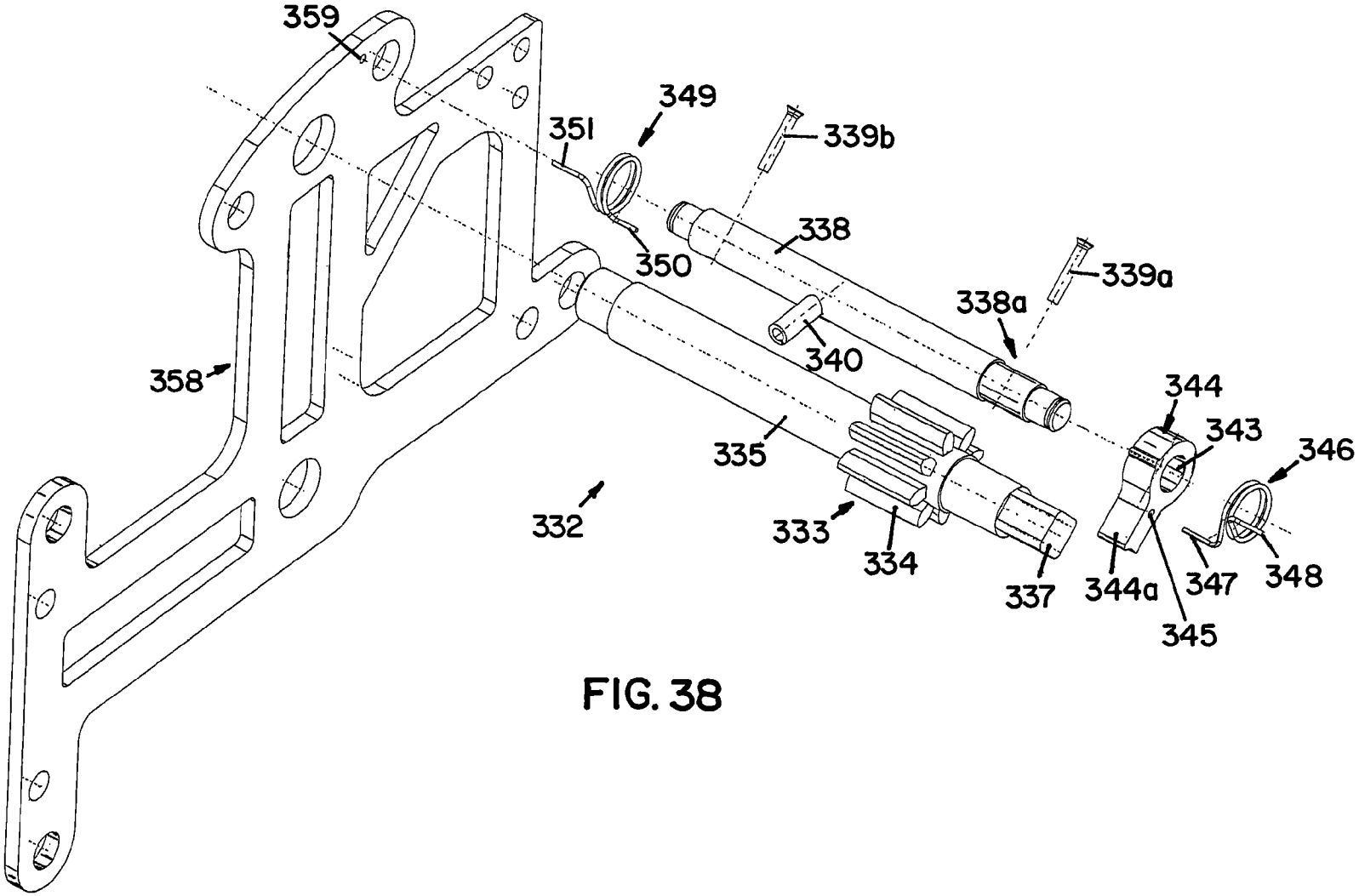
FIG. 38 is an exploded perspective view of a locking assembly of the retractable horizontal lifeline assembly shown in FIG. 27.

A locking assembly 332, as shown in FIG. 38, includes a pinion gear 333 with teeth 334, which cooperate and mate with the teeth 323 of the gear disk 322 of the brake assembly 320. The pinion gear 333 is operatively connected to a shaft 335 so as the shaft 335 rotates, the pinion gear 333 rotates and vice versa. Preferably, the pinion gear 333 is integral with the end of the shaft 335. Further, as the gear disk 322 rotates, the pinion gear 333 rotates and vice versa. One end of the shaft 335 extends through the first connector plate 354 and the other end of the shaft 335 extends through the second connector plate 358 and is pivotal therethrough. A first male connector 337 is operatively connected to an end of the shaft 335 proximate the pinion gear 333, and the first male connector 337, which extends outward from the housing 302, is used to tension the lifeline 540. Preferably, the first male connector 337 is integral with the end of the shaft 335.

A shaft 338 is parallel to the shaft 335 and extends through the first and second connector plates 354 and 358 and is pivotal therethrough. A pawl 344 has a bore 343 through which the shaft 338 is inserted, and the pawl 344 is proximate the pinion gear 333. The pawl 344 is preferably secured to the shaft 338 with a fastener 339*a*, which extends through a bore (not shown) of the pawl 344 corresponding with a bore 338*a* of the shaft 338. Preferably, the fastener 339*a* is a pin that is friction-fit through the bores. The pawl 344 also has an extension portion 344*a* extending outward proximate the bore 343, and the extension portion 344*a* has an aperture 345 proximate the bore 343. A first torsion spring 346 is wound about the shaft 338 and is placed between the pawl 344 and the first connector plate 354. A first end 347 of the torsion spring 346 is inserted through the aperture 345 of the pawl 344, and a second end 348 of the torsion spring 346 is inserted through the aperture 355 of the first connector plate 354. A second torsion spring 349 is wound about the shaft 338 and is place proximate the second connector plate 358. A first end 350 of the torsion spring 349 is held in position along the shaft 338 by a fastener 339*b* extending axially through the shaft 338, and a second end 351 of the torsion spring 349 is inserted through the aperture 359 of the second connector plate 354. The pawl 344 and the shaft 338 pivot together within apertures of the first and second connector plates 354 and 358 and the torsion springs 346 and 349 place a force upon the pawl 344 and the shaft 338 so that the extension portion 344*a* is urged in an upward direction to engage the teeth 334 of the pinion gear 333 thereby locking the drum 305 and preventing rotation of the drum 305 in a clockwise direction. The pawl 344 automatically locks the pinion gear 333, allowing the pinion gear 333 to be rotated in a clockwise direction and preventing the pinion gear 333 from being rotated in a counterclockwise direction. The pawl 344 has an engaging position and a releasing position. The engaging position sufficiently engages the teeth 334 of the pinion gear 333 to prevent the pinion gear 333 from rotating in a counterclockwise direction, and the releasing position does not sufficiently engage the teeth 334 thereby allowing the pinion gear 333 to be rotated in a clockwise direction. The direction of the rotation as described herein is relative to the embodiment as shown in FIG. 27, and it is recognized that the direction of rotation may change as the embodiment or the orientation of the embodiment changes.

The pinion gear 333 can be rotated in a clockwise direction and the teeth 334 push the pawl 344 downward away from the pinion gear 333 overcoming the force of the torsion springs 346 and 349 thereby allowing the pinion gear 333 to rotate in a clockwise direction. The torsion springs 346 and 349 continually places force on the pawl 344 and the shaft 338 that must be overcome to rotate the pinion gear 333. The pawl 344 creates a mechanical stop of the pinion gear 333 when the pinion gear 333 is rotated in a counterclockwise direction. This assists in tensioning the lifeline 540 because the drum can rotate in a counterclockwise direction but it cannot rotate in a clockwise direction while the pawl 344 engages the pinion gear 333.

The shaft 338 also includes a connector 340 extending outward perpendicular to the longitudinal axis of the shaft 338 toward the shaft 335. A push button 341 includes a notch (not shown) that straddles the connector 340, and the push button 341 extends through the top of the housing 302. A spring 342 biases the push button 341 away from the connector 340. When the push button 341 is pressed downward, the connector 340 is pushed downward, which overcomes the forces of the torsion springs 346 and 349 and rotates the shaft 338 in a counterclockwise direction thereby also rotating the pawl 344 in a counterclockwise direction to release the teeth 334 of the pinion gear 333. The push button 341 is a release mechanism that may be used to unlock the drum 305 to pay out the lifeline 540, to rewind the lifeline 540, and to release tension in the lifeline 540. The pinion gear 333 is automatically locked due to the torsion springs 346 and 349 placing forces upon the pawl 344 and the shaft 338 thereby automatically locking the gear disk 322 of the brake assembly 320.

Figure 27:
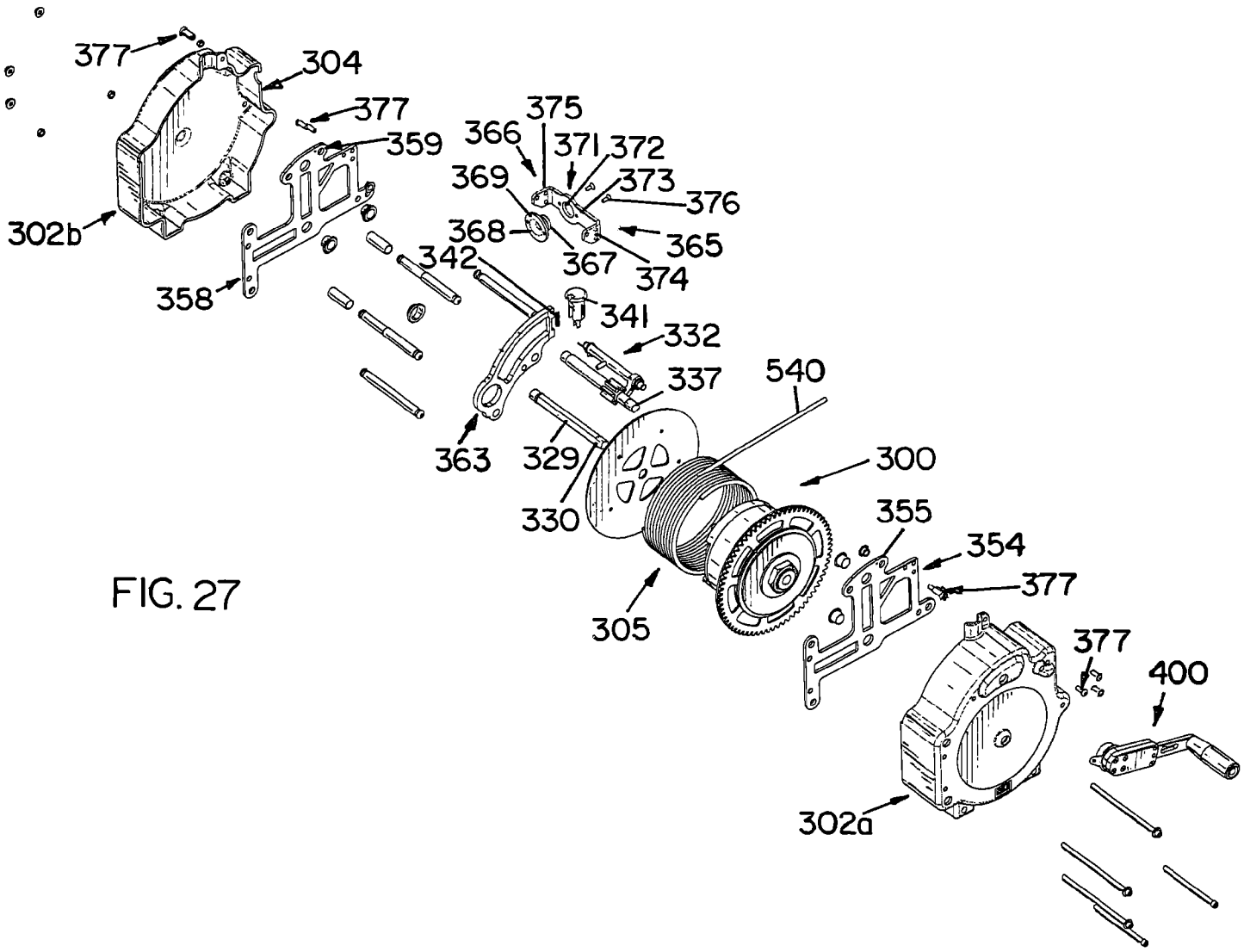
FIG. 27 is an exploded perspective view of the retractable horizontal lifeline assembly shown in FIG. 26.
Figure 28:
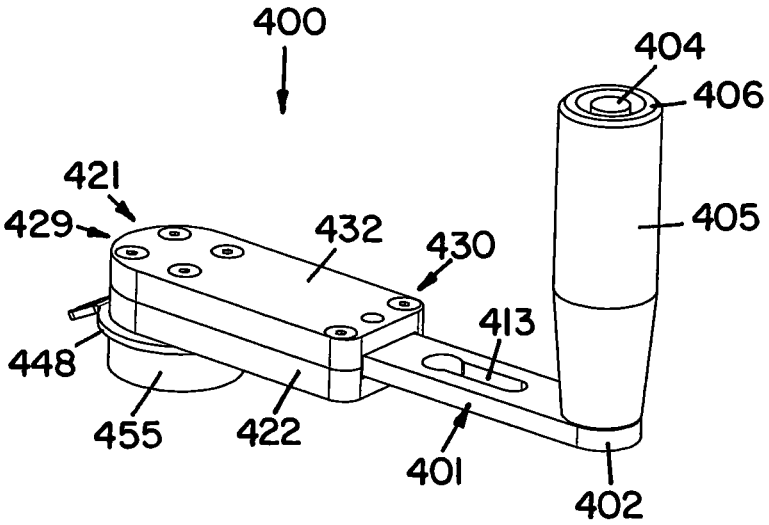
FIG. 28 is a perspective view of a crank of the retractable horizontal lifeline assembly shown in FIG. 26.
Figure 29:
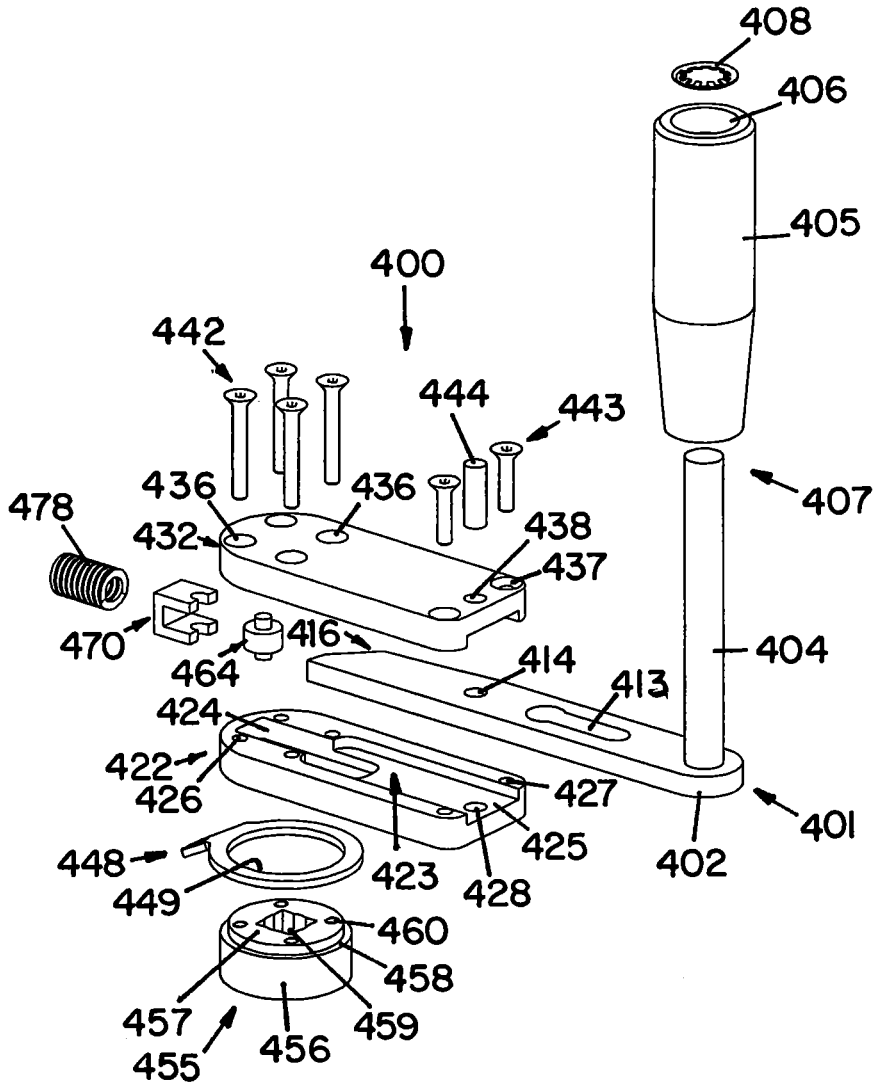
FIG. 29 is an exploded perspective view of the crank shown in FIG. 28.
Figure 36:
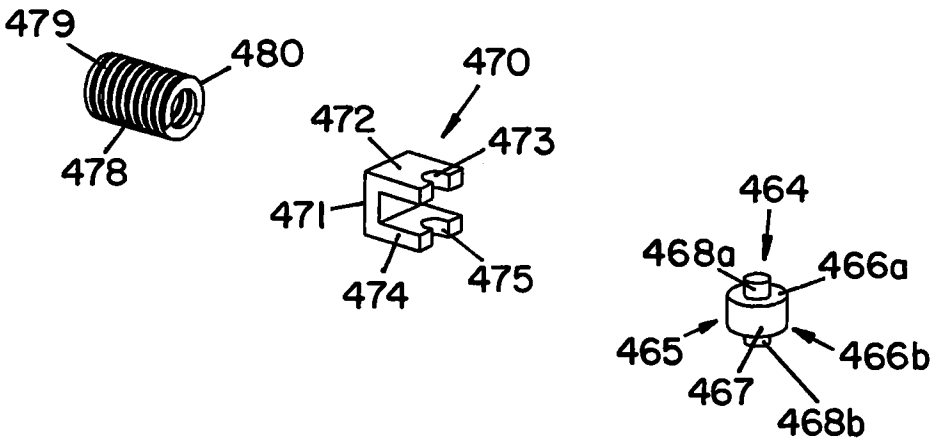
FIG. 36 is an exploded perspective view of a spring, a U-shaped member, and a roller of the crank shown in FIG. 28.

As shown in FIG. 27, an exit assembly 365 includes a friction pad 366, which is preferably generally funnel-shaped, with a cylindrical portion 367 and a flanged portion 368. The cylindrical portion 367 is configured and arranged to extend through an aperture 304 in the housing 302 and includes an opening 367*a* through which the lifeline 540 extends. The flanged portion 368 is proximate the inner surface of the housing 302 and reduces the friction and thus the wear on the lifeline 540 as the lifeline 540 is paid out from and rewound into the housing 302. A U-shaped bracket 371 includes sides 374 extending outward from opposing sides. An opening 372 in the bracket 371 is configured and arranged to receive the cylindrical portion 367. Apertures 369 in the flanged portion 368 correspond with apertures 373 in the bracket 371 and fasteners 376 extend therethrough to secure the friction pad 366 to the bracket 371. The sides 374 include apertures 375 through which fasteners 377 are used to secure the bracket 371 to the connector plates 354 and 358.

The drum 305, the brake assembly 320, the locking assembly 332, and the anchorage member 363 are operatively connected to the brackets 354 and 358 and housed between sides 302*a* and 302*b* as similarly described with respect to the retractable horizontal lifeline assembly 100. The dashed lines in FIG. 27 show how these components are connected. Although not shown in this embodiment, another anchorage member similar to the second anchorage member 130 of assembly 100 could be added as an optional feature.

The assembly 300 does not include a tension and fall indicator assembly like the tension and fall indicator assembly 221 of assembly 100. Rather, a crank 400 is used to tension the lifeline 540. The crank 400 includes an arm 401 with a first end 402, an intermediate portion 412, and a second end 416. The first end 402 preferably has rounded edges and includes an aperture 403 into which a rod 404 is placed and secured to the first end 402. The rod 404 is preferably welded to the first end 402. A handle 405 includes a bore 406 extending longitudinally therethrough. The rod 404 is inserted through the bore 406 of the handle 405 and the diameter of the bore 406 is large enough so that the handle 405 can rotate about the rod 404. The distal end 407 of the rod 404 is secured with a retaining ring 408, which allows the handle 405 to rotate about the rod 404 but prevents the handle 405 from coming off of the rod 404.

The intermediate portion 412 includes an aperture 413 proximate the first end 402. The aperture 413 is preferably key-hole shaped with the narrow portion proximate the first end 402 and is used to connect the crank 400 to the housing 302 of the assembly 300 when the crank 400 is not in use. The intermediate portion 412 also includes an aperture 414 proximate the aperture 413 and a middle portion of the arm 401.

The second end 416 includes a first tapered surface 417, a second tapered surface 418, and a third tapered surface 419. The first tapered surface 417 is preferably angled inward proximate the aperture 414 at approximately two to ten degrees, most preferably four to six degrees, relative to the side of the arm 401 from which it is angled inward. The second tapered surface 418 is preferably angled inward proximate the first tapered surface 417 to the second end 416 at approximately thirty to sixty degrees, most preferably forty-four to forty-six degrees, relative to the side of the arm 401 from which the first tapered surface 417 is angled inward. The third tapered surface 419 is preferably angled proximate the second tapered surface 418 to the opposing side of the arm 401 at approximately seventy to eighty-five degrees, most preferably seventy-nine to eighty-one degrees, relative to the side of the arm 401 from which the first tapered surface 417 is angled inward. It is recognized that these angles may vary. For example, the first tapered surface 417 does not need to be tapered at all as long as the arm 401 is able to be pivoted so that at least a portion of the surface is able to contact the first side 452.

A housing 421 includes a first plate 422 and a second plate 432 that cooperate to house some components of the crank 400. Inner surfaces of the first and second plates 422 and 432 include cavities 423 and 433 in which the components are housed. The first plate 422 is generally rectangular and includes a first end 429, which has rounded edges, and a second end 430. The cavity 423 includes a first portion 424 and a second portion 425. The first portion 424 is proximate the first end 429 that is generally rectangular and extends to proximate a middle portion of the first plate 422. The second portion 425 is also generally rectangular and is shallower than the first portion 424. The second portion 425 intersects a portion of the first portion 424 proximate the middle portion of the first plate 422 and extends to the second end 430. Bores 426 extend laterally through the first end 429 of the first plate 422. Preferably, two bores 426 are positioned on each side of the first portion 424, one proximate the end of the first portion 424 proximate the first end 429 and one proximate the juncture of the first portion 424 and the second portion 425. Bores 427 extend laterally through the second end 430. Preferably, one bore 427 is positioned proximate the second end 430 on each side of the second portion 425. The bores 427 are preferably threaded. An aperture 428 is positioned within the second portion 425 between the bores 427.

The second plate 432 is preferably similar to the first plate 422 and is shown in FIGS. 34 and 35. The second plate 432 includes a first end 439, which has rounded edges, and a second end 440. The cavity 433 includes a first portion 434 and a second portion 435. The first portion 434 is proximate the first end 439 that is generally rectangular and extends to proximate a middle portion of the first plate 432. The second portion 435 is also generally rectangular and is shallower than the first portion 434. The second portion 435 intersects a portion of the first portion 434 proximate the middle portion of the first plate 432 and extends to the second end 440. Bores 436 extend laterally through the first end 439 of the first plate 432. Preferably, two bores 436 are positioned on each side of the first portion 434, one proximate the end of the first portion 434 proximate the first end 439 and one proximate the juncture of the first portion 434 and the second portion 435. Bores 437 extend laterally through the second end 440. Preferably, one bore 437 is positioned proximate the second end 440 on each side of the second portion 435. An aperture 438 is positioned within the second portion 435 between the bores 437. The bores 436 and 437 are preferably countersunk to accommodate the heads of the fasteners 442 and 443, respectively.

A connector portion 455 includes a base 456 with a raised portion 457 extending outward therefrom. The base 456 and the raised portion 457 are generally cylindrical in shape and the raised portion 457 is smaller in diameter thereby forming a ledge 458 proximate the juncture of the base 456 and the raised portion 457. A ring member 448 includes an opening 449 and a flange 450 with an aperture 451 extending outward therefrom. The raised portion 457 fits within the opening 449 in the ring member 448 so that the ring member 448 is proximate the ledge 458 and the flange 450 extends outward from the connector portion 455. The connector portion 455 also includes a bore 459 extending laterally through proximate the center of the connector portion 455. The bore 459 is preferably square-shaped to correspond with the shape of the first male connector 337 and the second male connector 330. A bore 460 is preferably proximate each corner of the bore 459. The bores 460 are preferably threaded.

A U-shaped member 470 includes a top 471 with a first side 472 and a second side 474 extending outward from opposing sides of the top 471 parallel to one another. The first side 472 includes a notch 473 proximate the end opposite the top 471, and the second side 474 includes a notch 475 proximate the end opposite the top 471. A roller 464 includes a cylindrical portion 465 with side surfaces 466*a* and 466*b* and a rolling surface 467. A protrusion 468*a* extends outward proximate the center of the side surface 466*a* and a protrusion 468*b* extends outward proximate the center of the side surface 466*b*. The protrusion 468*a* fits within the notch 473 and the protrusion 468*b* fits within the notch 475 and the roller 464 is rotatable within the notches 473 and 475. As shown in FIG. 33, the U-shaped member, the roller 464, and a spring 478 are configured and arranged to fit within the first portions 424 and 434 of the housing 421.

To assemble the crank 400, the protrusions 468*a* and 468*b* of the roller 464 are placed within the notches 473 and 475 of the U-shaped member 470 and the spring 478 is placed proximate the top 471 with the roller 464 positioned opposite the spring 478. The second end 480 of the spring 478 contacts the top 471 of the U-shaped member 470. The spring 478, the U-shaped member 470, and the roller 464 are positioned within the first portion 424 of the first plate 422 with the first end 479 of the spring 478 proximate the first end 429 and the roller 464 proximate the second portion 425. The second end 416 and a portion of the intermediate portion 412 of the arm 401 are placed within the second portion 425 so that the second tapered surface 418 contacts the rolling surface 467 of the roller 464. The second plate 432 is then positioned so that its corresponding cavity 433, bores 436 and 437, and aperture the 438 are in alignment with the cavity 423, the bores 436 and 437, and the aperture 438 of the first plate 422. A pin 444 is inserted through the bore 438, the aperture 414, and the bore 428 to pivotally connect the arm 401 to the housing 421. The arm 401 may pivot about the pin 444 within the second portions 425 and 435. The first tapered surface 417 allows the arm 401 to pivot about the pin 444.

The raised portion 457 of the connector portion 455 is placed within the opening 449 of the ring member 448, and then the raised portion 457 is placed proximate the first plate 422 so that the bores 460 are in alignment with the bores 426. Fasteners 442, which are preferably screws, are inserted through the bores 436 and 426 and threaded into the bore 460 to secure the first and second plates 422 and 432 of the housing 421 and the connector portion 455 to the housing 421. Thus, the first and second plates 422 and 432 are sandwiched between the connector portion 455 engaged by the fasteners 442 and the heads of the fasteners 442. Fasteners 443, which are preferably screws, are threaded through the bore 437 and threaded into the bore 427 to secure the first and second plates 422 and 432 of the housing 421. Thus, the second plate 432 is sandwiched between the first plate 422 engaged by the fasteners 443 and the heads of the fasteners 443.

The rod 404 is inserted through the bore 406 of the handle 405 and the diameter of the bore 406 is large enough so that the handle 405 can rotate about the rod 404. The distal end 407 of the rod 404 is secured with a retaining ring 408, which allows the handle 405 to rotate about the rod 404 but prevents the handle 405 from coming off of the rod 404.

Although assembling the crank 400 is described with respect to the first plate 422, it is recognized that the second plate 432 may also be used. It is also recognized that the order of assembly is not crucial and may be changed.

Figure 26:
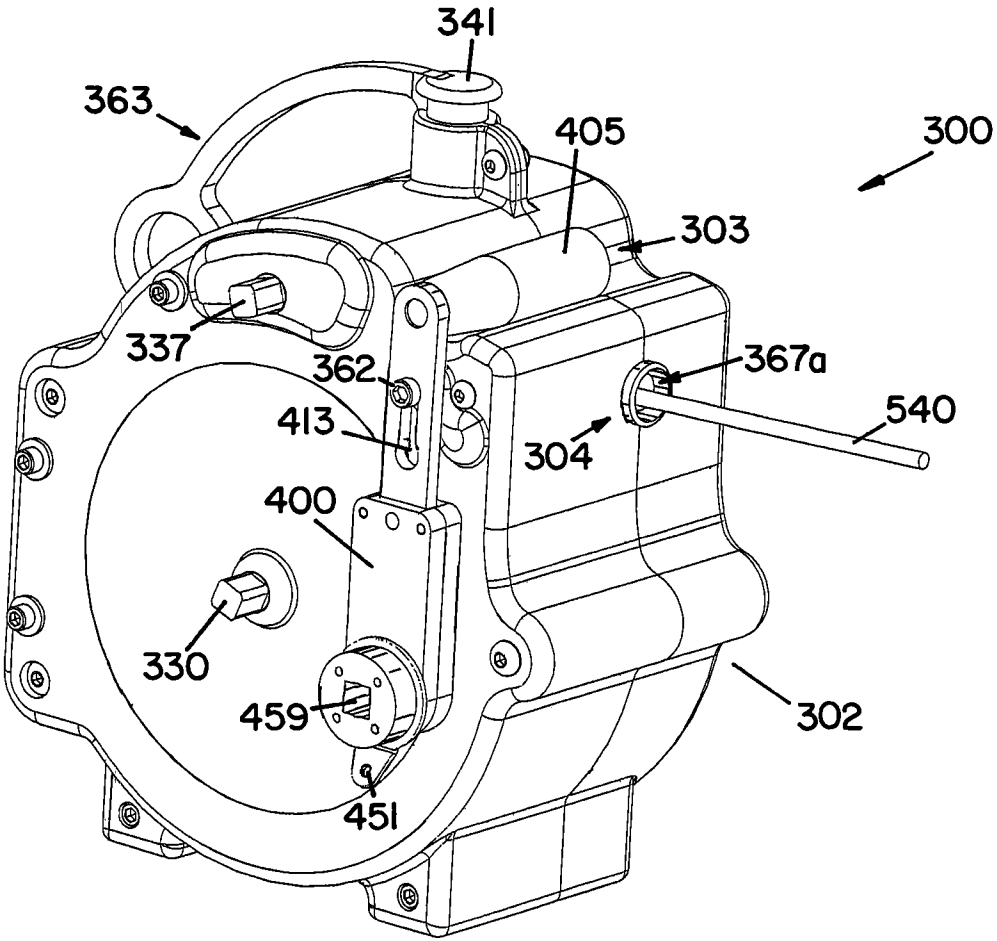
FIG. 26 is a perspective view of another embodiment retractable horizontal lifeline assembly constructed according to the principles of the present invention.

An end of a chain (not shown) may be operatively connected to the aperture 451 of the ring member 448 and the other end of the chain may be operatively connected to the housing 302 to assist in preventing the crank 400 from being misplaced or lost. When the crank 400 is not being used, it may be placed in a storage position by inserting a mushroom-shaped peg 362 extending outward from the housing 302 through the aperture 413. A sloped surface 303 proximate the top of the housing 302 above the peg 362 accommodates the handle 405 so it does not extend outward from the housing 302 as shown in FIG. 26.

The crank 400 may be connected to either the first male connector 337 or the second male connector 330 of the assembly 300 by inserting the first male connector 337 or the second male connector 330 into the bore 459, which is configured and arranged to receive the first male connector 337 and the second male connector 330. Although the first male connector 337, the second male connector 330, and the bore 459 are shown and described as being square-shaped, it is recognized that any suitable shapes, preferably corresponding shapes, may be used as long as the crank 400 can be used to rotate the first male connector 337 and the second male connector 330.

After the assembly 300 has been properly secured to anchorage structures, the lifeline 540 must be properly tensioned in order to function properly and safely arrest a fall. The crank 400 is operatively connected to the first male connector 337 by inserting the first male connector 337 into the bore 459. The handle 405 is turned thus rotating the first male connector 337, which in turn rotates the shaft 335 thereby rotating the pinion gear 333, which in turn rotates the gear disk 322 thereby rotating the drum 305 to wind the lifeline 540 more tightly about the base 306. The pinion gear 333 is rotated clockwise causing the pawl 344 to pivot downward releasing the teeth 334 of the pinion gear 333. Because the pawl 344 and the shaft 338 are biased by the torsion springs 346 and 349, the pawl 344 is biased so that it will pivot upward to engage the teeth 334 of the pinion gear 333. When rotation of the pinion gear 333 stops, the pawl 344 will pivot upward to engage the teeth 334 thereby locking the mechanism and preventing additional lifeline 540 from being paid out.

The pawl 344 automatically locks the pinion gear 333, allowing the pinion gear 333 to be rotated in a clockwise direction and preventing the pinion gear 333 from being rotated in a counterclockwise direction. This allows the lifeline 540 to be tensioned incrementally as the crank 400 turns the first male connector 337. The interaction between the gear disk 322 and the pinion gear 333 allows the lifeline 540 to be tensioned with less effort due to the mechanical advantage provided by the preferred 8.5:1 gear ratio between the gear disk 322 and the pinion gear 333. When the crank 400 is operatively connected to the second male connector 330 and the pinion gear 333 has been released from the pawl 344, the lifeline 540 may be rewound about the base 306.

To tension the lifeline 540, the crank 400 is connected to the first male connector 337 and the handle 405 is rotated to rotate the arm 401 in a clockwise direction thus rotating the first male connector 337 in a clockwise direction. The rotation of the first male connector 337 rotates the pinion gear 333, which rotates the gear disk 322, which rotates the drum 305 to wind the lifeline 540 more tightly about the base 306. With regard to the crank 400, initially the spring 478 biases the U-shaped member 470 and the roller 464 toward the second portions 425 and 435 thus positioning the roller 464 to contact the second tapered surface 418 and positioning the third tapered surface 419 proximate the second side 453 of the housing 421. The arm 401 may be pivoted about the pin 444 so that the first tapered surface 418 contacts the first side 452 and the side of the arm proximate the third tapered surface 419 contacts the second side 453. As the tension in the lifeline is increased, it becomes more difficult to rotate the crank 400 and increased torque is required to turn the crank 400 to further increase the tension in the lifeline. As the torque applied to the arm 401 is increased, the force of the spring 478 is overcome and as the spring 478 compresses and becomes more tightly coiled, the arm 401 begins to pivot about the pin 444 toward the first side 452 of the housing, which moves the roller 464 along the second tapered surface 418 toward the third tapered surface 419. The force of the spring 478 may initially only be partially overcome. When the lifeline has reached the desired tension, sufficient torque is required to overcome the force of the spring 478, thus sufficiently compressing the spring 478 so that the roller 464 reaches the third tapered surface 419 thus allowing the arm 401 to further pivot and the first tapered surface 417 contacts the first side 452 of the housing 421. When the first tapered surface 417 contacts the first side 452 of the housing 421, a "click" provides indication that the desired tension in the lifeline has been reached. The "click" includes a jerking motion of the arm 401 as it transitions from the second tapered surface 418 to the third tapered surface 419 and may even include an audible clicking sound as the first tapered surface 417 contacts the first side 452 of the housing 421. The arm 401 pivots far enough to be discernable to the touch or make an audible "click" sound when at least a portion of the first tapered surface contacts the first side 452.

More specifically, FIG. 33 shows the crank 400 in a position with no force (torque) applied to the arm 401. In this position, the arm 401 is proximate the second side 453. The spring 478, which is pre-tensioned, exerts force on the roller 464 to contact the second tapered surface 418 thus positioning the arm 401 proximate the second side 453. When the force of the spring 478 is overcome, the spring 478 is coiled tighter and the roller 464, originally in contact with the second tapered surface 418, moves to become in contact with the third tapered surface 419. When the roller 464 moves from the second tapered surface 418 to the third tapered surface 419, the arm 401 rotates until the first tapered surface 417 contacts the first side 452. When force (torque) is released from the arm 401, the spring 478 uncoils and urges the roller 464 to move from the third tapered surface 419 to contact the second tapered surface 418 thus pivoting the arm 401 proximate the second side 453. The tapered surfaces 417, 418, and 419 in combination with the spring 478 urge the arm 401 back into the position with no force (torque). The "click" occurs when the roller 464 moves from the second tapered surface 418 to the third tapered surface 419 and the first tapered surface 417 contacts the first side 452. The crank 400 may still be turned to further tension the lifeline. The first "click" merely indicates the minimal desired amount of tension in the lifeline has been reached, but the lifeline may be further tensioned to a greater amount and additional "clicks" may occur.

The force the spring 478 exerts upon the U-shaped member 470 and the roller 464 and the torque applied to the arm 401 required to overcome the force of the spring 478 is preferably preset to correspond with the desired tension in the lifeline. Therefore, when the "click" is detected, the desired tension in the lifeline has been reached. Although it is recognized that different types of lifelines may require different tensions to function properly, for a galvanized cable lifeline having a diameter of ¼ inch and a length of sixty feet, a suitable tension would be 350 pounds and the amount of torque applied to the arm 401 sufficient to tension the lifeline to 350 pounds would be 150 pounds per inch. These values are only examples as it is recognized that these values may vary with different tolerances such as the tension in the spring 478. Further, the amount of tension in the lifeline may vary depending upon what type of lifeline is used and the preferred tension in the lifeline. It is recognized that the more tension there is in the lifeline the less fall distance there will be. Other factors such as the length of the lifeline, the inclusion of an energy absorber in the system, the allowed clearance should a fall occur, and the desired arrest distance should a fall occur may affect the tension and the torque values. Given the possible variations, there could be wide ranges of acceptable values.

Pretension has a great effect on horizontal lifelines which do not incorporate separate energy absorbers. For these systems, a balance must be reached between maximum allowed horizontal lifeline tension and the vertical clearances required when using the system. The wire rope tensile strength (which is related to its construction, material and diameter) may limit the maximum allowed horizontal lifeline tension. Alternatively, the maximum allowed horizontal lifeline tension may be limited by the end anchorage strengths or any of the in-line components. The pretension for horizontal lifelines that incorporate energy absorbers (with sufficient extension) should be high to minimize the required clearance (the retractable horizontal lifeline of the present invention fits into this category). The pretension must be limited so the end anchorage, energy absorbers, or other in-line components are not activated or otherwise deformed in the absence of a fall. In addition, the pretension must be achieved without straining the installer. The energy absorber deploying force must be suitable for the end anchorages and in-line components. Many factors come into play in determining the pretension of a horizontal lifeline of which wire diameter is only one consideration.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A retractable horizontal lifeline assembly operatively connected to a first anchorage structure and to a second anchorage structure, comprising:

a) a lifeline having a first end, a second end, and an intermediate portion interconnecting the first end and the second end;

b) a drum having a base and being rotatable, the first end of the lifeline being operatively connected to the drum and the intermediate portion of the lifeline being windable about and paid out from the base;

c) a housing configured and arranged to house the drum and a portion of the lifeline wound about the base and including an exit through which another portion of the lifeline extends;

d) a brake assembly operatively connected to the drum including a main plate having first teeth;

e) a pinion gear having second teeth in cooperation with the first teeth whereby when the main plate rotates the first teeth engage the second teeth to cause the pinion gear to rotate;

f) a pawl pivotally mounted with respect to the housing proximate the pinion gear and having an engaging position and a releasing position, the engaging position engaging the second teeth preventing the pinion gear from rotating in a first direction, the releasing position releasing the second teeth allowing the pinion gear to rotate in the first direction, wherein when the pinion gear is engaged by the pawl, the main plate is also prevented from rotating in a second direction; and g) a crank selectively releasably operatively directly connectable to both a shaft of the drum and a shaft of the pinion gear to rotate the drum.

2. The retractable horizontal lifeline assembly of claim 1, further comprising:

a) a spring operatively connected to the pawl, the spring placing a force upon the pawl to bias the pawl in the engaging position; and b) a release mechanism operatively connected to the pawl, the release mechanism overcoming the force of the spring to place the pawl in the releasing position.

3. The retractable horizontal lifeline assembly of claim 1, wherein the lifeline is selected from the group consisting of wire cable, webbing, and synthetic rope.

4. The retractable horizontal lifeline assembly of claim 1, wherein the base includes a connector operatively connected to a portion of the intermediate portion of the lifeline a distance from the first end to create a reserve portion of lifeline between the connector and the first end, wherein the lifeline may be paid out from the base up to the connector and should a fall occur, the reserve portion is released from the connector.

5. The retractable horizontal lifeline assembly of claim 1, wherein the pinion gear is rotatable to tension the lifeline with reduced effort.

6. The retractable horizontal lifeline assembly of claim 1, wherein the crank is releasably operatively connectable to the pinion gear to rotate the pinion gear to tension the lifeline with reduced effort.

7. The retractable horizontal lifeline assembly of claim 6, wherein the crank includes a tension indicator indicating when the tension in the lifeline reaches a predetermined level.

8. The retractable horizontal lifeline assembly of claim 6, wherein the crank is releasably operatively connectable to the drum to rotate the drum to rewind the lifeline about the base of the drum.

9. The retractable horizontal lifeline assembly of claim 1, wherein the housing includes a first connector, the drum being rotatably mounted within the housing, the second end of the lifeline including a second connector, the first connector being configured and arranged to be releasably connected to the first anchorage structure and the second connector being configured and arranged to be releasably connected to the second anchorage structure.

10. The retractable horizontal lifeline assembly of claim 9, wherein the housing is configured and arranged to house the brake assembly, the pinion gear, and the pawl.

11. The retractable horizontal lifeline assembly of claim 1, further comprising a motor spring operatively connected to the drum and placing a force upon the drum, the motor spring automatically winding the lifeline about the drum when tension is released from the lifeline.

12. A retractable horizontal lifeline assembly operatively connected to a first anchorage structure and to a second anchorage structure, comprising:

a) a lifeline having a first end, a second end, and an intermediate portion interconnecting the first end and the second end, the second end including a second connector;

b) a drum having a base and being rotatable, the first end of the lifeline being operatively connected to the drum and the intermediate portion of the lifeline being windable about and paid out from the base;

c) a tension assembly;

d) a housing including a first connector and being configured and arranged to house the drum, the lifeline wound about the base of the drum, and the tension assembly, the drum being rotatably mounted within the housing, the tension assembly being mounted within the housing; and e) wherein the first connector is operatively connected to the first anchorage structure, the second end of the lifeline is pulled outward from proximate the housing thereby paying out at least a portion of the intermediate portion from the drum, the second connector is operatively connected to the second anchorage structure, and the tension assembly is used to fixedly tension the lifeline, wherein the tension assembly includes a brake assembly including a main plate having first teeth and includes a locking assembly comprising:

a) a pinion gear having second teeth in cooperation with the first teeth whereby when the main plate rotates the first teeth engage the second teeth to cause the pinion gear to rotate;

b) a pawl pivotally mounted with respect to the housing proximate the pinion gear and having an engaging position and a releasing position, the engaging position engaging the second teeth preventing the pinion gear from rotating in a first direction, the releasing position releasing the second teeth allowing the pinion gear to rotate in the first direction, wherein when the pinion gear is engaged by the pawl, the main plate is also prevented from rotating in a second direction; and c) a crank selectively releasably operatively directly connectable to both a shaft of the drum and a shaft of the pinion gear to rotate the drum.

13. The retractable horizontal lifeline assembly of claim 12, wherein the lifeline is selected from the group consisting of wire cable, webbing, and synthetic rope.

14. The retractable horizontal lifeline assembly of claim 12, wherein the base includes a connector operatively connected to a portion of the intermediate portion of the lifeline a distance from the first end to create a reserve portion of lifeline between the connector and the first end, wherein the lifeline may be paid out from the base up to the connector and should a fall occur, the reserve portion is released from the connector.

15. The retractable horizontal lifeline assembly of claim 12, wherein the brake assembly is operatively connected to the drum, the brake assembly absorbing energy and limiting a load on the anchorage structures should a fall occur.

16. The retractable horizontal lifeline assembly of claim 15, wherein the brake assembly is housed within the housing.

17. The retractable horizontal lifeline assembly of claim 12, further comprising:

a) a spring operatively connected to the pawl, the spring placing a force upon the pawl to bias the pawl in the engaging position; and b) a release mechanism operatively connected to the pawl, the release mechanism overcoming the force of the spring to place the pawl in the releasing position.

18. The retractable horizontal lifeline assembly of claim 12, wherein the crank is releasably operatively connectable to the pinion gear to rotate the pinion gear to tension the lifeline with reduced effort and is releasably operatively connectable to the drum to rotate the drum to rewind the lifeline about the base of the drum.

19. The retractable horizontal lifeline assembly of claim 12, wherein the pinion gear is rotatable to tension the lifeline with reduced effort.

20. The retractable horizontal lifeline assembly of claim 19, wherein the crank is releasably operatively connectable to the pinion gear to tension the lifeline.

21. The retractable horizontal lifeline assembly of claim 12, wherein the drum is rotatable to rewind the lifeline about the base of the drum.

22. The retractable horizontal lifeline assembly of claim 12, further comprising a crank releasably operatively connectable to the drum to rewind the lifeline.

23. The retractable horizontal lifeline assembly of claim 12, wherein the housing includes a handle configured and arranged to assist in carrying the retractable horizontal lifeline assembly.

24. The retractable horizontal lifeline assembly of claim 12, wherein the first connector includes a handle configured and arranged to assist in carrying the retractable horizontal lifeline assembly.

25. The retractable horizontal lifeline assembly of claim 12, wherein the first connector is configured and arranged to receive a connector selected from the group consisting of a carabiner, a snap hook, and a shackle.

26. The retractable horizontal lifeline assembly of claim 12, wherein the first connector is configured and arranged to releasably operatively connect to an anchorage structure selected from the group consisting of a bracket, a stanchion, an I-beam, and a post.

27. The retractable horizontal lifeline assembly of claim 12, wherein the tension assembly includes a tension indicator providing indication of the lifeline's tension and the lifeline moves the tension indicator with respect to the housing as the lifeline is being tensioned.

28. The retractable horizontal lifeline assembly of claim 12, wherein the base includes grooves assisting in evenly winding the lifeline initially around the base.

29. The retractable horizontal lifeline assembly of claim 12, wherein the tension assembly includes a tension indicator comprising:

a) a roller;

b) a third connector mounted within the housing;

c) a biasing member interconnecting the roller and the third connector, the biasing member placing a force upon the roller pulling the roller in a first direction toward the third connector; and d) the lifeline being routed between the roller and the third connector, wherein as the lifeline is tensioned, the lifeline pulls the roller in a second direction away from the third connector, the roller providing indication of the lifeline's tension.

30. The retractable horizontal lifeline assembly of claim 29, wherein the biasing member extends vertically within the housing and perpendicularly with respect to the lifeline as the lifeline is paid out of the housing.

31. The retractable horizontal lifeline assembly of claim 29, wherein the housing includes a window through which the roller can be viewed thereby providing indication of the lifeline's tension.

32. The retractable horizontal lifeline assembly of claim 29, wherein the roller includes a third end and a fourth end and the biasing member includes a first biasing member and a second biasing member, the first biasing member interconnecting the third end and the third connector, the second biasing member interconnecting the fourth end and the third connector.

33. The retractable horizontal lifeline assembly of claim 32, wherein the housing includes a window through which the third end of the roller extends thereby providing indication of the lifeline's tension.

34. The retractable horizontal lifeline assembly of claim 12, further comprising a motor spring operatively connected to the drum and placing a force upon the drum, the motor spring automatically winding the lifeline about the drum when tension is released from the lifeline.

35. The retractable horizontal lifeline assembly of claim 31, wherein the housing includes a bridge extending through the window, the third end of the roller breaking the bridge when a fall occurs to provide indication that a fall has occurred.

* * * * *